US010876211B2

(12) United States Patent
Morris

(10) Patent No.: US 10,876,211 B2
(45) Date of Patent: Dec. 29, 2020

(54) COMPOSITIONS FOR APPLICATION TO A METAL SUBSTRATE

(75) Inventor: Eric L. Morris, Murrieta, CA (US)

(73) Assignee: PRC-DeSoto International, Inc., Sylmar, CA (US)

( * ) Notice: Subject to any disclaimer, the term of this patent is extended or adjusted under 35 U.S.C. 154(b) by 75 days.

(21) Appl. No.: 13/235,317

(22) Filed: Sep. 16, 2011

(65) Prior Publication Data

US 2013/0071675 A1 Mar. 21, 2013

(51) Int. Cl.

| | |
|---|---|
| ***C23C 22/78*** | (2006.01) |
| ***C23C 22/83*** | (2006.01) |
| ***C23C 22/66*** | (2006.01) |
| ***C23C 22/60*** | (2006.01) |
| ***C23G 1/14*** | (2006.01) |
| ***C23G 1/22*** | (2006.01) |
| ***C23C 22/34*** | (2006.01) |

(52) U.S. Cl.

CPC ..... *C23C 22/78* (2013.01); *C23C 22/34* (2013.01); *C23C 22/60* (2013.01); *C23C 22/66* (2013.01); *C23C 22/83* (2013.01); *C23G 1/14* (2013.01); *C23G 1/22* (2013.01); *Y10T 428/31678* (2015.04)

(58) Field of Classification Search

CPC ..... C23C 22/78; C23C 22/34; C23C 33/60; C23C 22/66; C23C 22/83; C23G 1/14; C23G 1/22

See application file for complete search history.

(56) References Cited

U.S. PATENT DOCUMENTS

| | | | |
|---|---|---|---|
| 2,096,309 | A | 10/1937 | Pullen |
| 2,743,205 | A | 4/1956 | Condon |
| 2,839,439 | A | 6/1958 | Stapleton |
| 2,868,679 | A | 1/1959 | Pimbley |
| 3,096,261 | A | 7/1963 | Mekjean |
| 3,404,044 | A | 10/1968 | Warren |
| 3,523,875 | A | 8/1970 | Minklei |
| 3,864,230 | A | 2/1975 | Springer et al. |
| 3,869,317 | A | 3/1975 | Marx |

(Continued)

FOREIGN PATENT DOCUMENTS

| | | | |
|---|---|---|---|
| DE | 10-2008-060955 | A1 | 6/2009 |
| FR | 1326539 | A | 5/1963 |

(Continued)

OTHER PUBLICATIONS

JP49023140A, "Conversion coating for aluminium or its alloys corrosion resist layers obtd by treatment with lithium salts contg. alk hydroxide or carbonate solns", English Abstract, Mar. 1, 1974, Showa Aluminium Co., Ltd.

(Continued)

*Primary Examiner* — Kevin R Kruer

(74) *Attorney, Agent, or Firm* — Alicia M. Passerin, Esq.

(57) ABSTRACT

A corrosion resistant pretreatment composition for coating a metal substrate is provided. The composition comprises an aqueous carrier, one or more Group IA metal ions, wherein at least one of the Group 1A metal ions comprises a lithium compound, a hydroxide; and a phosphate or a halide. A process for treating a metal substrate with a lithium based coating is also provided, as well as a process for treating a metal substrate with a non-chrome conversion coating process.

15 Claims, 9 Drawing Sheets

(56) References Cited

U.S. PATENT DOCUMENTS

| | | | | | |
|---|---|---|---|---|---|
| 4,028,205 | A | | 6/1977 | Dorsey, Jr. | |
| 4,063,969 | A | | 12/1977 | Howell, Jr. | |
| 4,132,572 | A | * | 1/1979 | Parant | C23C 22/36 148/253 |
| 4,184,926 | A | | 1/1980 | Kozak | |
| 4,221,640 | A | | 9/1980 | Shibata et al. | |
| 4,371,589 | A | | 2/1983 | Warner et al. | |
| 4,385,940 | A | | 5/1983 | Kirihara et al. | |
| 4,420,378 | A | | 12/1983 | Tsubio et al. | |
| 4,762,638 | A | * | 8/1988 | Dollman et al. | 510/254 |
| 4,791,008 | A | | 12/1988 | Klotz et al. | |
| 5,047,095 | A | | 9/1991 | Geke et al. | |
| 5,112,395 | A | | 5/1992 | Ngo | |
| 5,266,356 | A | | 11/1993 | Buchheit, Jr. et al. | |
| 5,282,952 | A | * | 2/1994 | Sakaki | B41N 3/034 205/153 |
| 5,380,468 | A | * | 1/1995 | Gober | C11D 1/62 510/254 |
| 5,582,654 | A | | 12/1996 | Mansfeld et al. | |
| 5,622,569 | A | * | 4/1997 | Dennis | C11D 1/72 134/14 |
| 5,756,218 | A | | 5/1998 | Buchheit et al. | |
| 5,767,056 | A | | 6/1998 | Lenoir | |
| 5,932,083 | A | | 8/1999 | Stoffer et al. | |
| 5,942,052 | A | * | 8/1999 | Kamimura | C23C 22/08 148/250 |
| 6,022,425 | A | | 2/2000 | Nelson et al. | |
| 6,068,711 | A | | 5/2000 | Lu et al. | |
| 6,206,982 | B1 | | 3/2001 | Hughes et al. | |
| 6,406,562 | B1 | | 6/2002 | Lu et al. | |
| 6,432,899 | B1 | | 8/2002 | Sjostrom | |
| 6,451,443 | B1 | | 9/2002 | Daech | |
| 6,503,565 | B1 | | 1/2003 | Hughes et al. | |
| 6,844,114 | B2 | | 1/2005 | Gauthier et al. | |
| 7,264,661 | B2 | | 9/2007 | Maze et al. | |
| 7,452,427 | B2 | | 11/2008 | Morris | |
| 2004/0028820 | A1 | | 2/2004 | Stoffer et al. | |
| 2004/0126483 | A1 | | 7/2004 | Heimann et al. | |
| 2006/0213389 | A1 | | 9/2006 | Pearce et al. | |
| 2007/0184997 | A1 | * | 8/2007 | Hino et al. | 510/201 |
| 2007/0272900 | A1 | | 11/2007 | Yoshida et al. | |
| 2008/0081212 | A1 | | 4/2008 | Inbe et al. | |
| 2009/0062175 | A1 | * | 3/2009 | Cermenati et al. | 510/362 |

FOREIGN PATENT DOCUMENTS

| | | | | |
|---|---|---|---|---|
| FR | 1424715 | A | | 1/1966 |
| GB | 1500645 | A | | 2/1978 |
| GB | 2148942 | | * | 6/1985 |
| WO | 198806639 | | | 9/1988 |
| WO | 1996022406 | | * | 7/1996 |
| WO | WO 03/100130 | A2 | | 12/2003 |
| WO | 2008066319 | | | 6/2008 |
| WO | WO 2011/098322 | A1 | | 8/2011 |

OTHER PUBLICATIONS

Hinton, B.R.W. et al., "Cerium Conversion Coatings for the Corrosion Protection of Aluminium," Materials Forum, 9(3): 162-173 (1986).

Hinton, B.R.W. et al., "The Corrosion Protection Properties of a Cerium Oxide Conversion Coating on Aluminium Alloy AA 2024," ATB Metallurgie, vol. XXXVII, No. 2 (1997).

Csanady, A. et al., "The Relationship between the Corrosion Resistance and Impurity Content of Aluminium Oxide Layers," Corrosion Science, vol. 24, issue 3, pp. 237-248 (1984).

Extended European Search Report dated Mar. 5, 2014 in corresponding EP Application No. 12184766.9 (6 pages).

* cited by examiner

COMPOSITIONS FOR APPLICATION TO A METAL SUBSTRATE

BACKGROUND

Metals such as aluminum and their alloys have many uses in aerospace, commercial, and private industries. However, these metals have a propensity to corrode rapidly in the presence of water due to their low oxidation-reduction (redox) potential, thus significantly limiting the useful life of objects made from these metals, and/or increasing maintenance costs. These metals also have a significant problem with paint adhesion, as the surface of the metal, when formed into an object, is generally very smooth.

The oxidation and degradation of metals used in aerospace and automotive, commercial and private industries is a serious and costly problem. To prevent the oxidation and degradation of metals, inorganic coatings are applied to the metal's surface. These inorganic, protective coatings, also referred to as conversion coatings, may be the only coating applied to the metal, or there may be an intermediate coating to which subsequent coatings are applied.

Currently, chromate based coatings are used as conversion coatings in many industrial settings because they impart corrosion resistance to the metal surface, and promote adhesion in the application of subsequent coatings. However, these chromate based conversion coatings have become unfavorable, having toxicity, environmental, and regulatory concerns, and the cost to manufacturers for using chromate coatings is high and increasing due to disposal costs. Rare earth element containing coatings have been identified as potential replacements for chromate based coatings in metal finishing. Further information on such coatings can be found in: Hinton, B. R. W., et al., Materials Forum, Vol. 9, No. 3, pp. 162-173, 1986; Hinton, B. R. W., et al., ATB Metallurgie, Vol XXXVII, No. 2, 1997; U.S. Pat. Nos. 5,582,654; 5,932,083; 6,022,425; 6,206,982; 6,068,711; 6,406,562; and 6,503,565; U.S. Patent Application Publication No. US 2004/0028820 A1; and PCT Application Publication No. WO 88/06639. However, at least some of the coatings prepared using known prior art compositions and methods do not perform as well as those formed using chromate treatments and/or can develop blisters on the surface and exhibit poor adhesion.

Bucheit (U.S. Pat. No. 5,266,356) reports a variety of lithium based coatings for use as substitutes for chromate based conversion coatings, reporting that Csanady et al. in *Corrosion Science,* 24, 3, 237-248 (1984) shows that alkali and alkali earth metals stimulated $Al(OH)_3$ growth on aluminum alloys. However, Csanady et al. reports that the incorporation of $Li^+$ or $Mg^{2+}$ into a growing oxide film degrades corrosion resistance. Bucheit (U.S. Pat. No. 5,266,356) discloses coatings containing alkali metal salts such as $Li_2CO_3$, $Li_2SO_4$, LiCl, LiOH, and LiBr, and alkaline earth metal salts, such as $MgCl_2$ and $MgBr_2$, and $MgCO_3$, which have been identified as potential substitutes for chromate based coatings. Disadvantageously, however, as reported in Bucheit U.S. Pat. No. 5,756,218, col. 2, lines 33-40, these coatings were reported not to provide beneficial sealing of the protective film. Bucheit (U.S. Pat. No. 5,266,356) also teaches heating the coated alloy after immersion in the salt bath (col. 3). Heating large parts is industrially not feasible or cost prohibitive for industrial applications. Further, as noted in Daech (U.S. Pat. No. 6,451,443, col. 3, lines 25-29), alkaline lithium carbonate solutions, such as described in Bucheit, do not provide sufficient corrosion resistance for high copper aluminum alloys.

Bucheit (U.S. Pat. No. 5,756,218) reports yet other coatings containing lithium salts. However, these coatings were reported to require a second sealing coat having a soluble metal salt to improve the corrosion resistance. The process described in Bucheit (U.S. Pat. No. 5,756,218) is a multistep process including cleaning, rinsing, degreasing at elevated temperature, rinsing, deoxidizing in an acid solution and rinsing again followed by treatment with the Li solution. An additional rinsing step is also reported after the sealing step. Further, the "hydrotalcite" films described in Bucheit (U.S. Pat. No. 5,756,218, col. 3, lines 40-50) may degrade in acid and neutral solution and a post film heat treatment is required to create a more corrosion resistant film. Each step in a process that requires additional rinsing/sealing/or coating adds to the cost of an industrial process in labor and materials. Also, as described by Daech (U.S. Pat. No. 6,451,443, col. 2, lines 5-14), regarding the coating compositions described in Bucheit, lithium carbonates produces "talcite", which does not allow the organic topcoat to bond well. Daech, U.S. Pat. No. 6,451,443, also reports that these coatings are not sufficient for high copper aluminum alloys and the hydrotalcite chemical film was found incompatible to the top paint.

Daech (U.S. Pat. No. 6,451,443) describes lithium molybdate coating solutions and describes that corrosion was still found on the panels after testing, especially on high copper containing Aluminum 2024T3 panels (col. 3, lines 25-29). Daech also describes the undesirability of using other Group 1A metal salts (i.e., alkali metal salts), such as sodium hydroxide (col. 5, lines 29-32). Daech discloses excessive coating times to achieve the desired results, such as times ranging from 1.5 to 8 hours immersion (col. 5). The subsequent coating step with Cerium chloride requires an additional oxidizer ($H_2O_2$), and Daech further reports that "simply dipping alloys in $CeCl_3$ or $Ce(NO_3)_3$ solutions without additives did not improve the corrosion resistance of the alloy (col. 3, lines 52-58). Further, Daech (col. 4) requires different plating parameters for different alloys and different processes, such as Al 7075 having a preferred specific pH range of 10.2-10.3 for the coating composition when dipping is used, and for Al 2024, a higher pH range, from 10.5-10.7, when dipping is used, and yet another pH of 11 when the coating is applied by spraying. These pH ranges do not overlap, requiring different batches and baths for different alloys and process steps. The long immersion times of the coatings described in Daech are not industrially feasible, as well as the different pH's for different metal alloys or processes, which makes the process not industrially feasible for parts with multi-metals.

The use of a lithium based, phosphate containing composition using an alkaline pH is not known in the art. Though not specifically reported, this may be attributed to lithium's tendency to readily precipitate with phosphates, causing an undesired reaction leading to formulation instabilities. However, embodiments of this current art utilize this tendency to precipitate Li and phosphorus by controlling the reaction and limiting it's formation to the substrate's surface. This is achieved either by selectively choosing the oxidation state or steric hindrance of the starting phosphorus compound, or by allowing waters of hydration to form around the phosphorous compound prior to introduction to the Li compounds.

Accordingly, at least some of the prior art coatings suffer from one or more of the following disadvantages: (1) poor corrosion resistance, especially on high copper containing alloys; (2) poor adhesion; (3) the necessity to use multiple steps and extensive periods of time to deposit a coating; (4) the use of commercially unattractive steps, such as additional rinsing, deoxidizing, and/or sealing steps; (5) and/or the use of elevated temperature solutions; and (6) do not teach a conversion coating that has self-healing ability in a corrosive environment.

The ability to deposit a conversion coating composition on the surface of a high copper-containing aluminum alloy, such as aluminum 2024, which is thick enough to provide corrosion protection and paint adhesion, and without the use of chromates has been problematic. Therefore, there is a need for a conversion coating that can replace chromate based conversion coatings and that overcomes several of the deficiencies, disadvantages and undesired parameters of known replacements for chromate based conversion coatings. Further, there is a need for a chromate free conversion coating that imparts corrosion resistance and self-healing characteristics to a metal surface and also promotes adhesion of subsequent coatings.

SUMMARY

According to the present invention, a corrosion resistant pretreatment coating composition for coating a metal substrate is provided. The pretreatment coating comprises an aqueous carrier and one or more Group IA metal ions, wherein at least one of the Group 1A metal ions is a lithium ion. Although in certain embodiments lithium is the preferred Group 1A metal ion, it will be understood to those of skill in the art that magnesium may be substituted for lithium due to the diagonal relationship between lithium and magnesium. In addition to the Group 1A metal ion, the pretreatment coating compositions contain a combination of hydroxide and halide or phosphate ions in an aqueous solution. In one embodiment, the pretreatment coating composition comprises an aqueous carrier, lithium and a combination of hydroxide and phosphate ions in solution. In another embodiment, the pretreatment coating composition comprises an aqueous carrier, lithium and a combination of hydroxide and halide ions in solution. Preferably, the pretreatment coating compositions are substantially free of Group 3 through Group 12 metals (transition metals), chromates, other metallates and oxidizing agents, and in some preferred embodiments, and the pretreatment compositions are substantially free of all metals except Group 1A metals.

The pretreatment coating compositions have the advantage that they are chromate free and do not possess the accompanying environmental and human toxicity of chromate based compositions, as well as the associated cost of waste storage and environmental remediation of chromates. As the pretreatment coating compositions are formulated from Group 1A metals, they are far less expensive to manufacture than other coatings containing more expensive transition metals. This is a significant factor in the aerospace and automotive industries which require coating large areas of substrates to produce aircraft, automobiles, and trucks/trailers, resulting in significant cost savings. Most significantly, the pretreatment coating compositions containing a combination of hydroxide and halide or phosphate ions are viable alternatives to chromate based conversion coatings. As detailed herein above, other known pretreatment conversion coatings are not able to satisfactorily provide corrosion protection, especially for higher strength Aluminum alloys, such as Al 2024, and/or the known prior art pretreatment coatings require processing steps which are not industrially feasible or are cost prohibitive.

The coating according to the present invention differ from the known prior art in the following ways: (1) the present invention does not require a heating step, i.e., heating above ambient temperature, to cure the coatings, such as described in Bucheit (U.S. Pat. Nos. 5,266,356; and 5,756,218); (2) additional degreasing/deoxidizing and/or rinsing steps are not required, such as also described in Bucheit, as the alloy is not used as a Li source, and the Li has been put into the degreasing/deoxidizing step; (3) the subsequent Ce coating is applied at a lower pH (about 4.5), as opposed to greater than 10, and coatings of the same pH may be applied to all Al alloys, whereas Daech describes a higher and variable pH for the coatings described therein; (4) the compositions are preferably free of metal oxides and metals aside from Group I or II, whereas, Daech employs a molybdate form of Li; and (5) that both Daech and Bucheit post-treat or seal the alloys with a composition comprising Ce with $H_2O_2$ (oxidant) seal. The present invention does not require that the subsequent sealing step have an oxidant and embodiments of the present invention do not require rinsing of the sealing step, as do Daech and Bucheit. Further, the resulting coatings have the ability to self-heal scratched areas in corrosive environments, which has not been found in prior art coatings.

Some embodiments of the pretreatment corrosion resistant coatings described herein employ a lithium salt composition having a combination of at least two different anions. The combination of anions described herein impart superior characteristics to the coatings, the coatings do not require heating above ambient temperature after coating, are suitable for mixed alloy aluminum parts, and the coatings accordingly have industrial applicability. Further, the pretreatment coatings according to the present invention impart superior corrosion resistance to a variety of aluminum alloys, including high-copper alloys, and perform at a level comparable to chromate based coatings. The pretreatment coatings are able to provide corrosion resistance after more than 24 hours exposure to ASTM-B-117 salt spray exposure. And further, the pretreatment coating compositions described herein provide corrosion resistance after salt spray exposure of 4 days, some embodiments achieving corrosion resistance comparable to chromates after salt spray exposure of 14 days.

The pretreatment coating compositions also exhibit good adhesion to metal substrates, minimize the tendency to over-coat, can be used to treat multiple aluminum alloys of low to relatively high copper content, and can be used as part of a complete chromate-free coating system. Another advantage of the pretreatment coating composition is the ability of the coating composition to be used in conjunction with a paint system, such as with a primer and topcoat that provides corrosion resistance comparable to known chromate containing systems.

According to one embodiment, the pretreatment coating composition is an aqueous composition for application to a metal substrate comprising an aqueous carrier, a hydroxide, a phosphate, and one or more Group IA metal ions, preferably selected from the group consisting of lithium, sodium and potassium ions, wherein at least one of the Group 1A metal ions is a lithium ion. In certain embodiments, the Group 1A metal ions comprise lithium and at least one other Group 1A metal ion, and preferably, the composition comprises a sodium compound. The composition may further comprise one or more additional components selected from the group consisting of carbonates, surfactants, chelators, thickeners, allantoin, polyvinylpyrrolidone, 2,5-Dimercapto-1,3,4-thiadiazole, halides, such as fluoride, silanes and alcohols.

In a preferred embodiment, the composition comprises lithium carbonate ($Li_2CO_3$), sodium hydroxide (NaOH), sodium phosphate ($Na_3PO_4$), a surfactant, and optionally polyvinylpyrrolidone. In another preferred embodiment, the composition comprises lithium hydroxide (LiOH) and lithium di-hydrogen phosphate ($LiH_2PO_4$). In a more preferred embodiment, the composition comprises an aqueous carrier, lithium hydroxide (LiOH), and a pyrophosphate $(P_2O_7)^{4-}$ or phosphate $(PO_4)^{3-}$, and optionally a surfactant.

According to another embodiment, the composition comprises an aqueous carrier, one or more Group IA metal ions, wherein at least one of the Group 1A metal ions is a lithium ion, a hydroxide, a fluoride, and optionally a surfactant and/or polyvinylpyrrolidone.

According to another embodiment, the composition comprises an aqueous carrier, one or more Group IA metal ions, wherein at least one of the Group 1A metal ions is a lithium ion, a hydroxide, a phosphate, and one or more additional components selected from the group consisting of carbonates, surfactants, chelators, thickeners, allantoin, polyvinylpyrrolidone, 2,5-Dimercapto-1,3,4-thiadiazole, halides, silanes and alcohols.

According to another embodiment, the composition comprises an aqueous carrier, a lithium ion and at least one other Group 1A metal ion, a carbonate, a hydroxide, a phosphate and one or more additional components selected from the group consisting of surfactants, chelators, thickeners, allantoin, polyvinylpyrrolidone, 2,5-Dimercapto-1,3,4-thiadiazole, halides, silanes and alcohols.

According to another embodiment, the composition comprises an aqueous carrier, one or more Group IA metal ions, wherein at least one of the Group 1A metal ions is a lithium ion, a hydroxide, a fluoride and one or more additional components selected from the group consisting of carbonates, surfactants, chelators, thickeners, allantoin, polyvinylpyrrolidone, 2,5-Dimercapto-1,3,4-thiadiazole, halides, silanes and alcohols.

According to another embodiment, a metal substrate comprising a deoxidized or degreased aluminum or aluminum alloy substrate is provided. The substrate is contacted with a coating composition according to the invention.

According to another embodiment, a process for treating a metal substrate is provided. According to the process, first a metal substrate is provided. Next, the metal substrate is contacted with a coating composition according to the present invention. In certain embodiments, the coating composition comprises a lithium salt, a hydroxide and is substantially free of phosphates. Next, the metal substrate is contacted with a coating composition comprising a rare earth coating composition, preferably having one or more Ce or Y salts and a nitrate.

FIGURES

These and other features, aspects and advantages of the present invention will become better understood from the following description, appended claims, and accompanying figures where:

Figure 8:
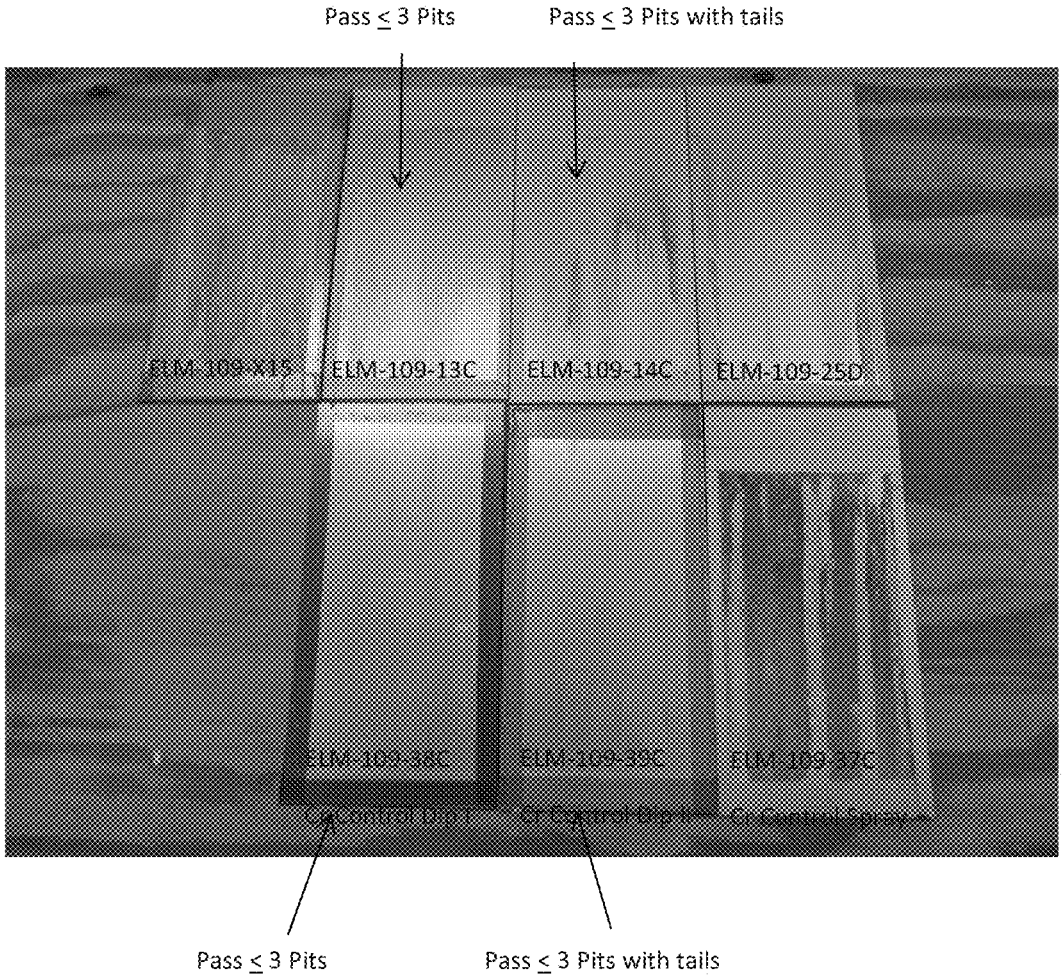
Figure 9:
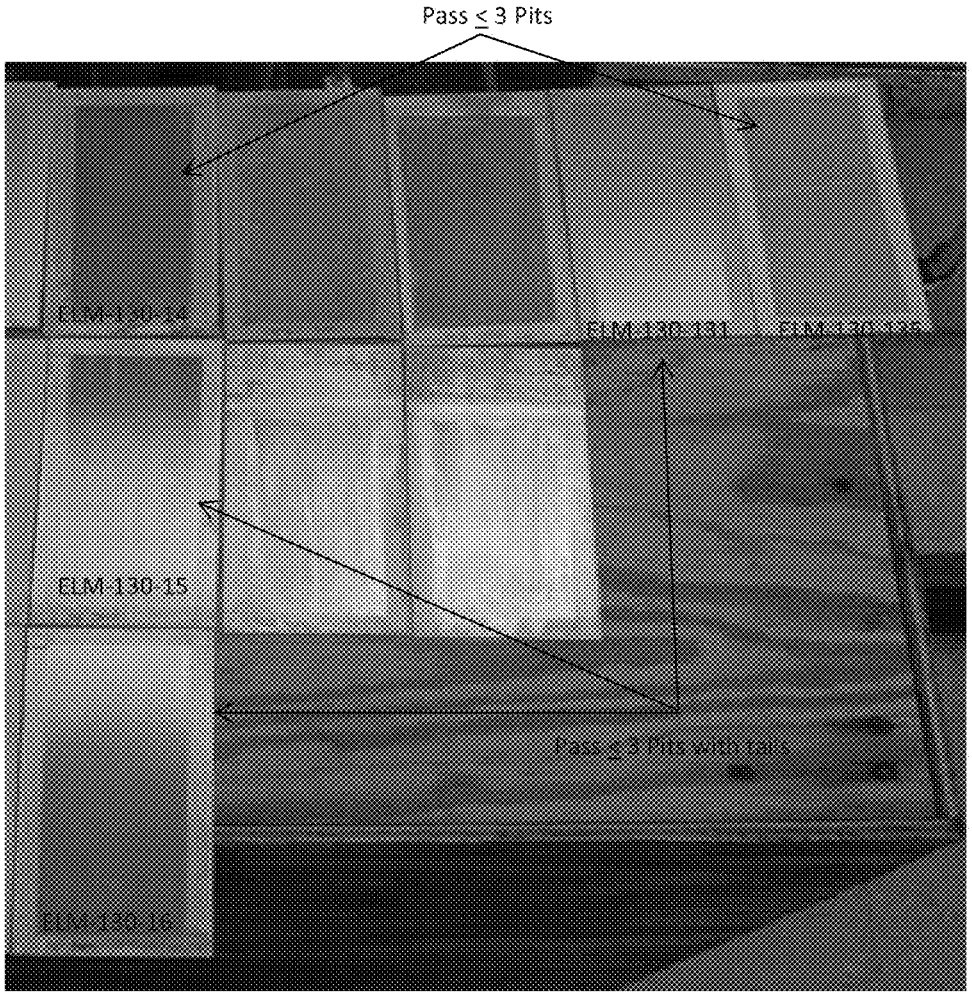

FIG. 8 is an array of comparison panels showing panels coated with lithium based coatings according to the invention and chromate coated panels after a 14 day salt spray test, according to another embodiment of the invention; and FIG. 9 is another array of comparison panels showing panels coated with lithium based coatings according to other embodiments the invention and chromate coated panels after a 14 day salt spray test.

DESCRIPTION

According to one embodiment of the present invention, there is provided corrosion resistant pretreatment coating compositions for coating a metal surface, also referred to as a metal substrate. The pretreatment compositions preferably are lithium based coating compositions and minimize or overcome problems of known coating compositions, especially for higher strength Al alloys, such as Aluminum 2024, which is known for having poor corrosion resistance. Further, the lithium based coating compositions according to the invention are able to achieve suitable adhesion with subsequently applied paints and primers.

As used herein, the following terms have the following meanings.

The term "substrate" means a material having a surface. In reference to applying a conversion coating, the term "substrate" refers to a metal substrate such as aluminum, iron, copper, zinc, nickel, magnesium, and alloys thereof. Preferred substrates are aluminum and aluminum alloys. More preferable substrates are high copper aluminum substrates.

The term "coating" as used herein, refers to the process of applying a composition, i.e., contacting a substrate with a composition, such as contacting a substrate with a conversion coating, primer, and/or topcoat. The term "coating" may be used interchangeably with the terms "application/applying" "treatment/treating" or "pretreatment/pretreating", and may also be used to indicate various forms of application or treatment, such as painting, spraying and dipping, where a substrate is contacted with a composition by such application means.

The term "conversion coating", also referred to as a "conversion treatment" or "pretreatment" means a treatment for a metal substrate that causes the metal surface to be converted to a different material. The meaning of the terms "conversion treatment" and "conversion coating" also include an application or treatment for a metal surface where a metal substrate is contacted with an aqueous solution having a metal that is a different element than the metal contained in the substrate. An aqueous solution having a metal element in contact with a metal substrate of a different element, where the substrate dissolves, leading to precipitation of a coating (optionally using an external driving force to deposit the coating on the metal substrate), is also within the meaning of the terms "conversion coating" and "conversion treatment".

The term "Group 1A metal" means a metal ion from the first column of the periodic table, also known as the alkali metals.

The term "metallate" means a complex anion containing a metal ligated to several atoms or small groups.

The term "rare earth element" means an element in Group IIIB of the periodic table of the elements, that is, elements 57-71 and Yttrium.

The term "transition metallate" means a metallate compound containing a transition metal (i.e., Group 3-12 metal).

As used in this disclosure, the term "comprise" and variations of the term, such as "comprising" and "comprises," are not intended to exclude other additives, components, integers, ingredients or steps.

All amounts disclosed herein are given in weight percent of the total weight of the composition at 25° C. and one atmosphere pressure, unless otherwise indicated.

According to one embodiment of the invention, a lithium based composition for coating a metal substrate is provided. The composition comprises an aqueous carrier and one or more Group IA metal ions, wherein at least one of the Group 1A metal ions is a lithium ion. The composition is alkaline containing a combination of hydroxide and phosphate or halide ions in solution. The hydroxide ions are present in the composition, preferably, in an amount of from about 0.09 to about 16 g/1000 g solution. The phosphate ions are preferably selected from the group consisting of phosphate $(PO_4)^{3-}$, di-hydrogen phosphate $(H_2PO_4)^-$, or pyrophosphate $(P_2O_7)^{4-}$, and are preferably present in solution in an amount of from about 0.2 g/1000 g solution to about 16 g/1000 g solution. Other phosphates include organo phosphates, such as Dequest™ obtainable from Monsanto (St. Louis, Mo.). Halide ions, preferably fluoride ions, present as NaF in solution, are preferably in an amount of from about 0.2 g/1000 g solution to 1.5 g/1000 g solution. In some embodiments, the composition may also include carbonate ions, preferably, the carbonate ions are present in solution in an amount of from about 0.05 g/1000 g solution to about 12 g/1000 g solution. Preferred Group 1A metal ions include lithium, sodium, and potassium, and a preferred composition comprises an aqueous alkaline composition having a combination of lithium hydroxide and sodium pyrophosphate in an aqueous solution.

The composition may contain other components and additives such as but not limited to carbonates, surfactants, chelators, thickeners, allantoin, polyvinylpyrrolidone, 2,5-Dimercapto-1,3,4-thiadiazole, halides, adhesion promoters, such as adhesion promoting silanes (e.g., silanes having an amine and/or hydroxyl functionality; or a zirconium alkoxide and a silane coupling agent) and alcohols. Preferred additives include a surfactant (preferably present in the solution in an amount of from about 0.015 g/1000 g solution to 1 g/1000 g solution). A surfactant suitable for use in the present invention includes Dynol 604, commercially available from Air Products, having offices in Allentown, Pa., and polyvinylpyrrolidone (preferably present in the solution in an amount of from about 0.015 g/1000 g solution to about 5 g/1000 g solution).

In a preferred embodiment, the lithium based coating composition comprises an alkaline aqueous carrier and one or more Group IA metal ions, wherein at least one of the Group 1A metal ions is a lithium ion, a hydroxide ion, a phosphate ion, and optionally one or more metal salt or additive selected from the group consisting of carbonates, surfactants, chelators, thickeners, allantoin, polyvinylpyrrolidone, 2,5-Dimercapto-1,3,4-thiadiazole, halides (preferably fluoride), adhesion promoting silanes, and alcohols. One example according to this embodiment is an aqueous solution comprising lithium hydroxide (LiOH) and lithium di-hydrogen phosphate ($LiH_2PO_4$) and a surfactant. Another example according to this embodiment is an aqueous solution comprising lithium hydroxide (LiOH) and sodium pyrophosphate ($Na_4P_2O_7$) or sodium phosphate ($Na_3PO_4$) and a surfactant.

In another preferred embodiment, the lithium based coating composition comprises an alkaline aqueous carrier, a lithium ion, at least one other Group 1A metal ion, a carbonate ion, a hydroxide ion, a phosphate ion, and one or more additives selected from the group consisting of surfactants, chelators, thickeners, allantoin, polyvinylpyrrolidone, 2,5-Dimercapto-1,3,4-thiadiazole, halides (preferably fluoride), adhesion promoting silanes, and alcohols. One example according to this embodiment is an aqueous solution comprising lithium carbonate ($Li_2CO_3$), sodium hydroxide (NaOH) and sodium phosphate ($Na_3PO_4$) and a surfactant, and optionally further comprising polyvinylpyrrolidone.

In another preferred embodiment, the lithium based coating composition comprises an alkaline aqueous carrier, one or more Group IA metal ions, wherein at least one of the Group 1A metal ions is a lithium ion, a hydroxide ion, a halide (preferably fluoride) ion, and one or more additives selected from the group consisting of carbonates, surfactants, chelators, thickeners, allantoin, polyvinylpyrrolidone, 2,5-Dimercapto-1,3,4-thiadiazole, adhesion promoting silanes, and alcohols. One example according to this embodiment is an aqueous solution comprising lithium hydroxide (LiOH), sodium fluoride (NaF) and a surfactant.

According to some preferred embodiments, the lithium based coating composition will comprise lithium and at least one other Group 1A metal ion, preferably selected from the group consisting of lithium, sodium and potassium ions. Preferably, the lithium ion is present in the composition in an amount of from about 0.02 g/1000 g solution to about 12 g/1000 g solution, and more preferably in an amount of from about 1 to 2 g/1000 g solution. When sodium ions are present in the composition, the sodium ion is present in the composition in an amount of from about 0.2 g/1000 g solution to about 16 g/1000 g solution.

In each of the above described preferred embodiments and examples, the potassium version of the salt may also be used in place of the sodium salt, e.g., KOH for NaOH. And, it is preferable that all lithium salts are not used if the total lithium concentration is above the desired concentration for a given composition. Certain lithium salts may not be as soluble as desired or be too acidic for the alkaline composition. For example, lithium phosphate is fairly insoluble in the aqueous composition, and lithium di-hydrogen phosphate may be too acidic. Therefore, $Na^+$ or $K^+$ phosphates or pyrophosphates may be more desirable.

The lithium based coating compositions according to the invention are substantially chromate free, and preferably are substantially free of Group 3 through Group 12 metals, and in some embodiments are substantially free of metals other than Group 1A metals.

The pH of the lithium based coating compositions is preferably above 10, and the preferred temperature range of the composition, when applied to a substrate, is from about 15 degrees C. to about 120 degrees C. More preferably, the lithium based coating compositions are applied to a metal substrate at room temperature, about 15 degrees C. to about 25 degrees C.

According to another embodiment of the invention, a metal substrate comprising an aluminum or aluminum alloy substrate coated with a composition comprising a lithium based aqueous composition according to the invention is provided. For the purpose of this disclosure, preferred metal substrates are aluminum, zinc, ferrous, and magnesium substrates. More preferred metal substrates are high copper containing aluminum alloys such as Aluminum 2024.

In one embodiment, the lithium based coating composition comprises an aqueous carrier, lithium and a combination of hydroxide and phosphate ions in solution. Optionally, a second Group 1A metal ion, and/or a surfactant and/or polyvinylpyrrolidone is added to the composition which is applied to the metal substrate. In another embodiment, the lithium based coating composition comprises an aqueous carrier, lithium and a combination of hydroxide and halide ions in solution. Optionally, a second Group 1A metal ion, and/or a surfactant and/or polyvinylpyrrolidone is added to the composition which is applied to the metal substrate. Preferably, the lithium based compositions are alkaline, more preferably having a pH greater than 10, and also preferably, the lithium based compositions are substantially free of Group 3 through Group 12 metals (transition metals), chromates, other metallates and oxidizing agents, and in some preferred embodiments, the lithium based compositions are substantially free of metals except Group 1A metals.

According to another embodiment of the invention, a metal substrate, preferably an aluminum or aluminum alloy substrate metal substrate, coated with a composition comprising one of the aqueous lithium based compositions according to the invention is provided. The metal substrate is then further coated with a rare earth conversion coating, optionally followed by coating with a primer coat, and/or a topcoat. In an alternate embodiment, the metal substrate is coated with a composition comprising lithium hydroxide without a phosphate, or polyvinylpyrrolidone and cellulose. The metal substrate is subsequently coated with a rare earth conversion coating as described above.

According to another embodiment, the metal substrate may be pre-treated prior to contacting the metal substrate with one of the lithium based coatings according to the present invention. The term pre-treating refers to a surface modification of the substrate that enhances the substrate for subsequent processing. Such surface modification can include one or more operations, including, but not limited to cleaning (to remove impurities and/or dirt from the surface), deoxidizing, and/or application of one or more solutions or coatings, as is known in the art. Pretreatment has many benefits, such as generation of a more uniform starting metal surface, improved adhesion of a subsequent coating to the pretreated substrate, or modification of the starting surface in such a way as to facilitate the deposition of the subsequent conversion coating.

According to another embodiment, the metal substrate may be prepared by first solvent treating the metal substrate prior to contacting the metal substrate with one of the lithium based coating compositions according to the invention. The term "solvent treating" refers to rinsing, wiping, spraying, or immersing the substrate in a solvent that assists in the removal of inks and oils that may be on the metal surface. Alternately, the metal substrate may be prepared by degreasing the metal substrate with conventional degreasing methods prior to contacting the metal substrate with one of the lithium based coating compositions according to the invention.

The metal substrate may be pre-treated by solvent treating the metal substrate. Then, the metal substrate is pre-treated by cleaning the metal substrate with an alkaline cleaner prior to application of one of the lithium based coating compositions according to the invention. A preferred pre-cleaner is a basic (alkaline) pretreatment cleaner. The pre-cleaner may also have one or more corrosion inhibitors, some of which may "seed" the surface of the metal substrate during the cleaning process with the corrosion inhibitor to minimize metal surface attack, and/or facilitate the subsequent conversion coating. Other suitable pre-cleaners include degreasers and deoxidizers, such as Turco 4215-NCLT, available from Telford Industries, Kewdale, Western Australia; Amchem 7/17 deoxidizers, available from Henkel Technologies, Madison Heights, Mich.; and a phosphoric acid-based deoxidizer, such as Deft product code number 88X2.

In another embodiment, the metal substrate is pre-treated by mechanically deoxidizing the metal prior to placing one of the lithium based coating compositions on the metal substrate. An example of a typical mechanical deoxidizer is uniform roughening of the surface using a Scotch-Brite pad.

In another embodiment, the metal substrate is pre-treated by solvent wiping the metal prior to placing one of the lithium based coating compositions on the metal substrate.

An example of a typical solvent is methylethylketone (MEK), methylpropylketone (MPK), acetone, and the like.

Additional optional steps for preparing the metal substrate include the use of a surface brightener, such as an acid pickle or light acid etch, a smut remover, as well as immersion in an alkaline solution per one of the embodiments of this disclosure.

The metal substrate may be rinsed with either tap water, or distilled/de-ionized water between each of the pretreatment steps, and may be rinsed well with distilled/de-ionized water and/or alcohol after contact with one of the lithium based coating compositions according to the invention.

Once the metal substrate has been appropriately pretreated, one of the lithium based coating compositions according to the invention is then allowed to come in contact with at least a portion of the metal's surface. The metal substrate is contacted with one of the lithium based coating compositions using any conventional technique, such as dip immersion, spraying, or spread using a brush, roller, or the like. With regard to application via spraying, conventional (automatic or manual) spray techniques and equipment used for air spraying be used. In other embodiments, the coating can be an electrolytic-coating system or the coating can be applied in paste or gel form. The lithium based coating compositions may be applied in any suitable thickness, depending on the application requirements. In some embodiments, the lithium based coatings are applied using a touch-up pen.

When the metal substrate is coated by immersion, the immersion times may vary from a few seconds to multiple hours based upon the nature and thickness of the desired lithium based coating composition. Preferred dwell times are less than 30 minutes. Most preferred dwell times are three minutes or less. When the metal substrate is coated using a spray application, a lithium based coating composition solution is brought into contact with at least a portion of the substrate using conventional spray application methods. The dwell time in which the lithium based coating composition solution remains in contact with the metal substrate may vary based upon the nature and thickness of conversion coating desired. Dwell times range from a few seconds to multiple hours. Preferred dwell times are less than 30 minutes. Most preferred dwell times are three minutes or less. When the metal substrate is treated using a gel application, the lithium based coating composition gel is brought into contact with at least a portion of the metal substrate using either conventional spray application methods or manual swabbing. The dwell time in which the lithium based coating composition gel remains in contact with the metal substrate may vary based upon the nature and thickness of the desired coating. Typical dwell times range from a few seconds to multiple hours. Preferred dwell times are less than 30 minutes. Most preferred dwell times are three minutes or less. The lithium based coating compositions may also be applied using other techniques known in the art, such as application via swabbing, where an appropriate media, such as cloth, is used to soak up the conversion coating solution and bring it into contact with at least a portion of a metal substrate's surface. Again, the dwell time in which one of the lithium based coating compositions solution remains in contact with the metal substrate may vary based upon the nature and thickness of the desired coating. Dwell times range from a few seconds to multiple hours. Preferred dwell times are less than 30 minutes. Most preferred dwell times are three minutes or less. If an externally driven electrolytic application process is desired, such as electroplating, care should be given to the concentration level of halides present in the conversion coating plating bath, such as to not generate harmful species, such as chlorine gas or other harmful by-products. After contacting the metal substrate with one of the lithium based coating compositions, the coated metal substrate may be air dried then rinsed with tap water, or distilled/de-ionized water. Alternately, after contacting the metal substrate with one of the lithium based coating compositions, the coated metal substrate may be rinsed with tap water, or distilled/de-ionized water, and then subsequently air dried.

In a preferred but not required embodiment, a lithium based coating composition according to the invention is first applied to a metal substrate for about 1 to about 10 minutes, (preferably about 3 to about 5 minutes), keeping the surface wet by reapplying the coating composition. Then, the lithium based coating composition is allowed to dry, preferably in the absence of heat greater than room temperature, for about 5 to about 10 minutes (preferably about 7 minutes) after the last application of the lithium based coating composition. According to some embodiment, alcohol may be included in a rinsing step which allows for the omission of the drying step. After the drying step, the metal substrate which has been treated with a lithium based coating composition may be further treated with a rare earth conversion coating, such as a Cerium or Yttrium based conversion coating. Preferred coatings include those having Cerium and/or Yttrium salts. Though rare earth coatings are preferred, any solution chemistry that is capable of forming a precipitate upon a change in pH may be used, such as but not limited to those known in the art. Examples include trivalent chrome, such as Alodine 5900; zirconium, such as Alodine 5700, sol gel coatings, such as Boegel and AC 131; cobalt coatings, vanadate coatings; molybdate coatings; permanganate coatings; and the like, as well as combinations, such as but not limited to Y and Zr; and RECC 3012 (Deft, Inc.). Examples of rare earth conversion coatings are described in U.S. Pat. No. 7,452,427 (Morris), commercially available from Deft, Inc. having offices in Irvine, Calif. The rare earth conversion coating is applied to the lithium treated metal substrate for about 5 minutes. The substrate is preferably not rinsed, and the metal substrate may then be further coated with primers and/or top coats to achieve a substrate with a finished coating.

Figure 1A:
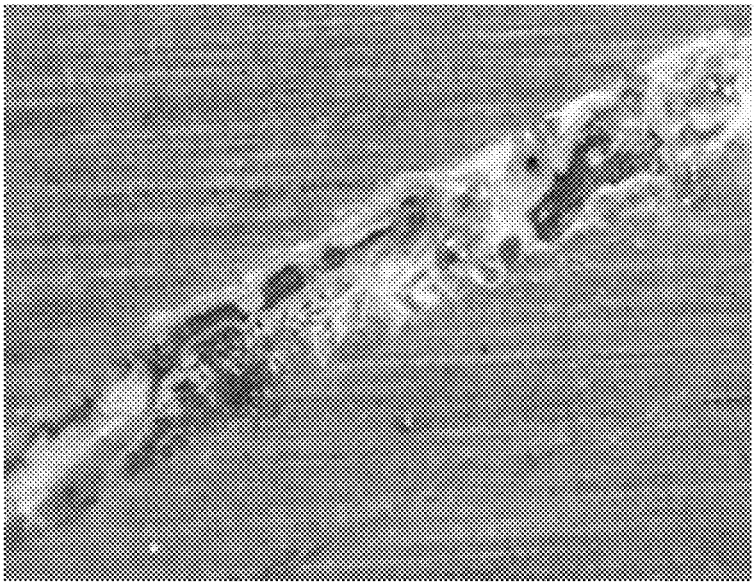
FIG. 1A and FIG. 1B are samples of aluminum substrates coated with pretreatment compositions comprising lithium and a phosphate according to one embodiment of the present invention.
Figure 1B:
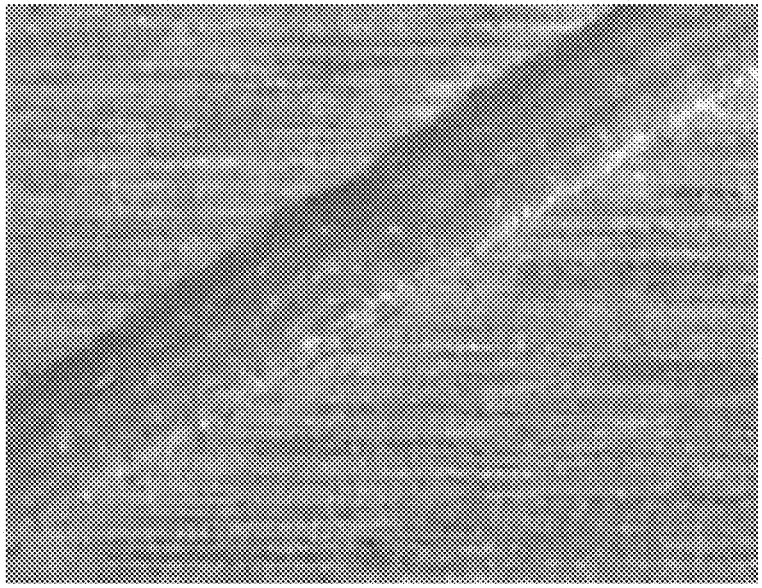

Referring now to FIG. 1A and FIG. 1B, samples of aluminum substrates coated with lithium based compositions comprising a phosphate according to the present invention are shown. In FIG. 1A and FIG. 1B, two Al 2024-T3 substrates are shown at 50× Magnification after coating with a lithium based conversion coating according to the invention, followed by a rare earth conversion coating and then a four day salt spray exposure. FIGS. 1A and 1B show different embodiments of the invention and how, according to the protection desired, the compositions can provide barrier protection, as shown in FIG. 1A, or barrier and self-healing, as shown in FIG. 1B. FIG. 1B, coated with a lithium based composition which clearly exhibits "self-healing" of the scratch, is a preferred formulation.

Figure 2A:
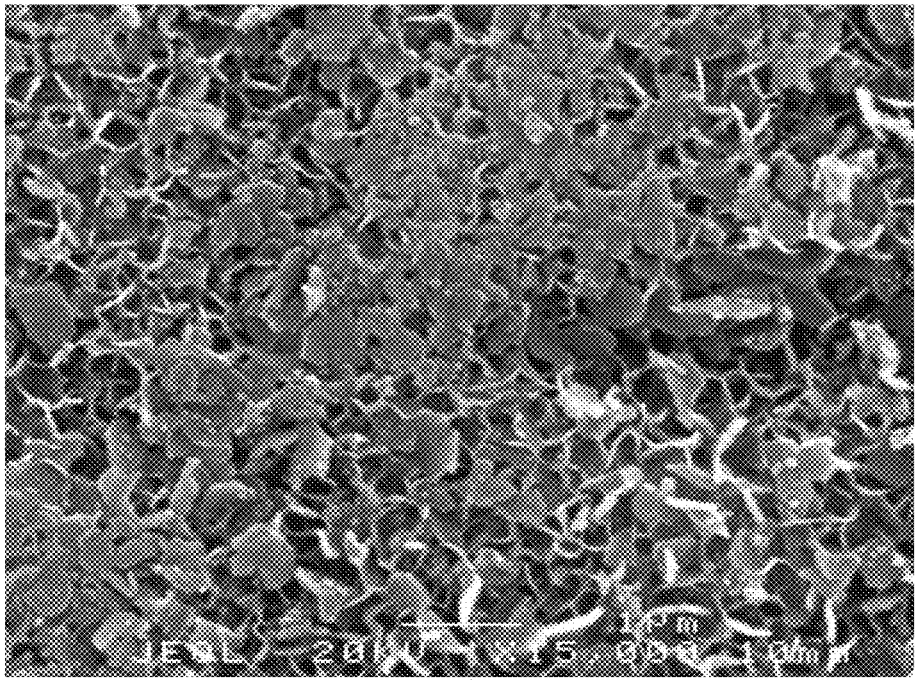
FIG. 2A and FIG. 2B are SEM Micrographs at 15K Magnification of an Al 2024-T3 substrate coated with a lithium based conversion coating, followed by a second coating with a rare earth conversion coating, according to another embodiment of the invention.
Figure 2B:
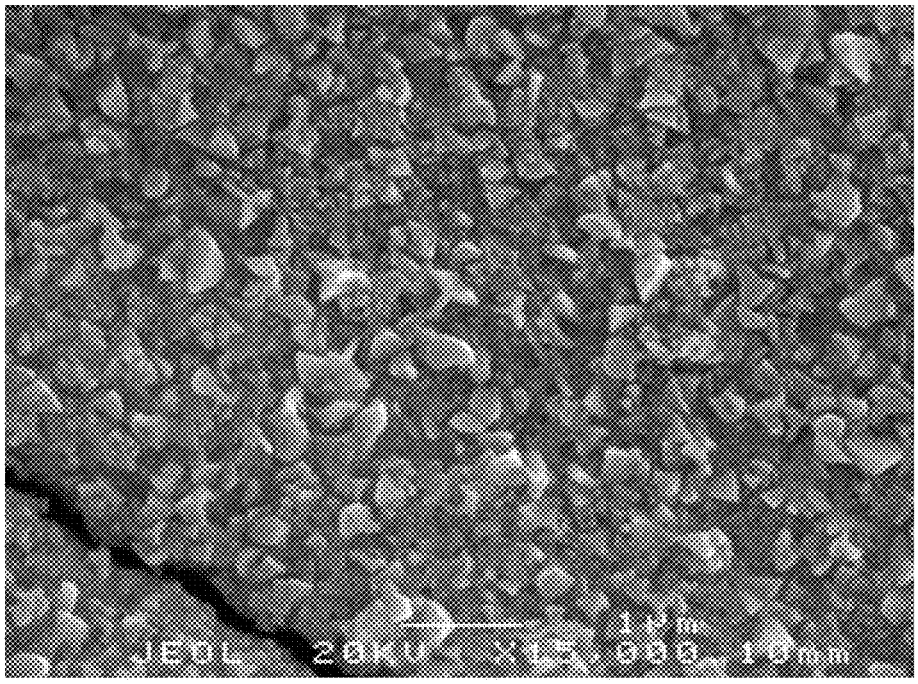

FIG. 2A and FIG. 2B are SEM Micrographs at 15K Magnification of an Al 2024-T3 substrates coated with a lithium based conversion coating according to the invention followed by a rare earth conversion coating. FIG. 2A shows the coated substrate before the salt spray test. FIG. 2B shows the coated substrate in the scribe area after the four day salt spray test. FIG. 2B demonstrates the self healing ability of the coating.

Figure 3A:
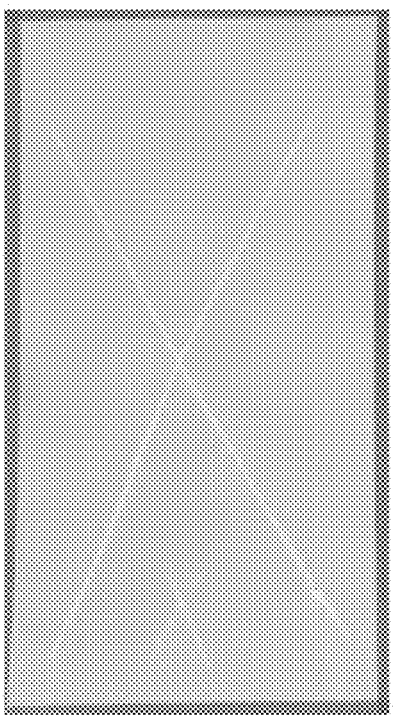
FIG. 3A and FIG. 3B are Al 2024-T3 substrates coated with various lithium based conversion coatings according to an embodiment, followed by a second coating with a rare earth conversion coating, then primer coated with Deft 02GN093 Primer, according to another embodiment of the invention, after a 2000 hour salt spray exposure.
Figure 3B:
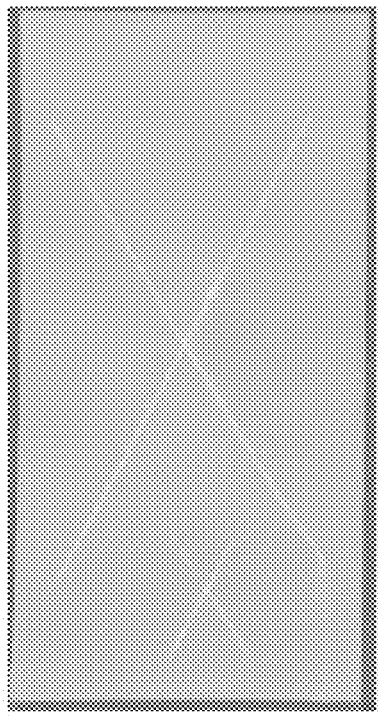

Referring now to FIG. 3A and FIG. 3B, Al 2024-T3 substrates coated with various lithium based conversion coatings, followed by a second coating with a rare earth conversion coating, then primer coated with Deft 02GN093 Primer, according to another embodiment of the invention are shown. The panels were subjected to a 2000 hours salt spray exposure. As shown in FIGS. 3A and 3B, the representative panels with chrome free primer system show good adhesion and little or no corrosion after the 2000 hour salt spray exposure, exhibiting the viability of the coatings of the present invention in a non-chrome system.

Figure 4:
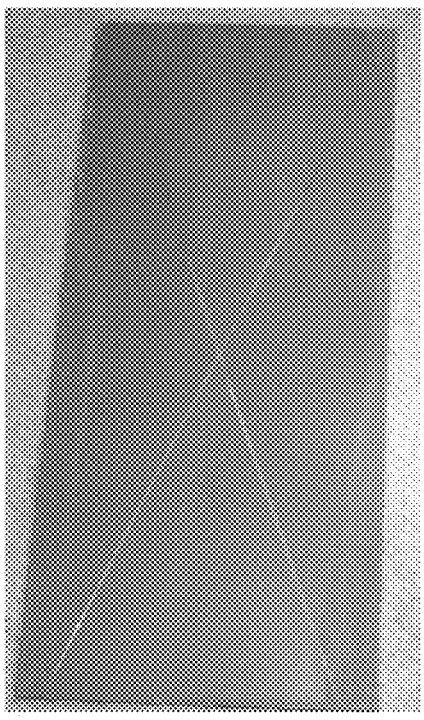
FIG. 4 is an aluminum alloy substrate coated with a lithium based conversion coatings according to an embodiment of the invention, followed by a second coating with a rare earth conversion coating RECC 3021™ (Deft, Inc.), then primer coated with Deft 02GN093 Primer, according to another embodiment of the invention, after a 2000 hour salt spray exposure.

Referring now to FIG. 4, an aluminum alloy substrate panel coated with a lithium based conversion coatings according to an embodiment of the invention is shown. The substrate was coated with the lithium based coating, followed by a second coating with a rare earth conversion coating RECC 3021™ (Deft, Inc.), then primer coated with Deft 02GN093 Primer. The panel was then subjected to a 2000 hour salt spray exposure test. As shown in FIG. 4, the coating according to the present invention shows little or no corrosion.

Figure 5A:
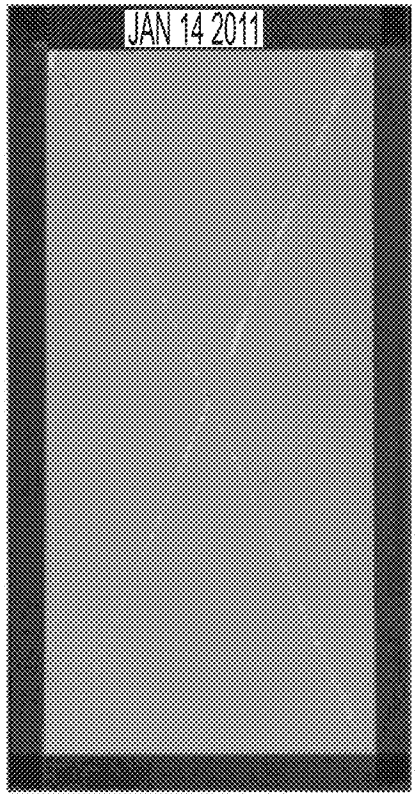
FIG. 5A is an Al2024 panel coated with a lithium based conversion coatings according to an embodiment of the invention, followed by a second coating with a rare earth conversion coating RECC 3021™ (Deft, Inc.), then primer coated with Deft 02Y040A Chromated Primer and APC Topcoat 99GY013, after a 2000 hour salt spray exposure.
Figure 5B:
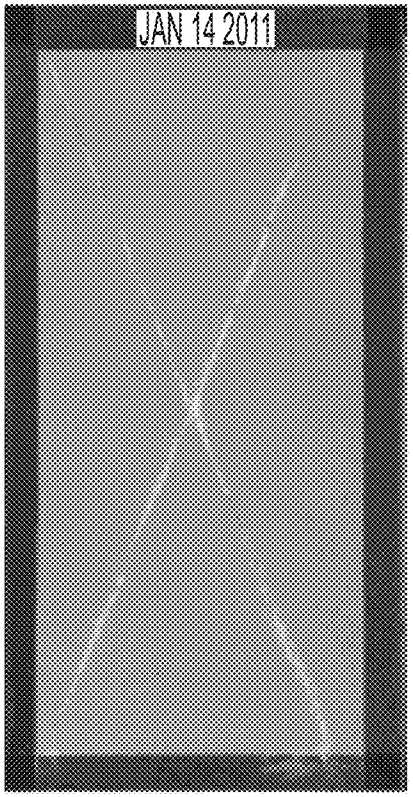
FIG. 5B is an Al2024 comparison panel conversion coated with a non-hexavalent chromium conversion coating, then primer coated with Deft 02Y040A Chromated Primer and APC Topcoat 99GY013, after a 2000 hour salt spray exposure.
Figure 5C:
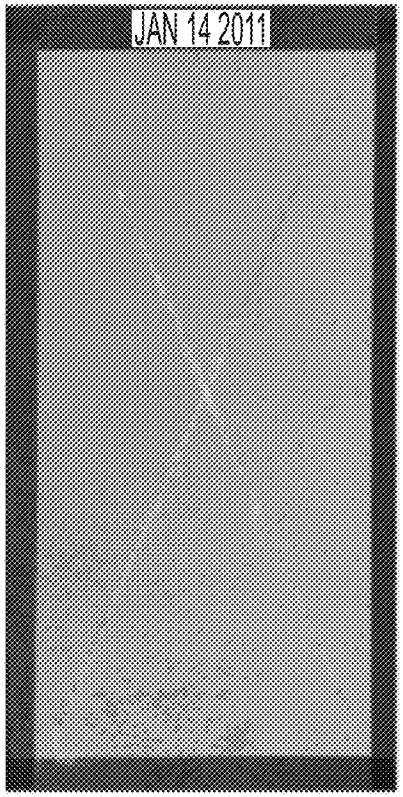
FIG. 5C is an Al2024 comparison panel conversion coated with a hexavalent chromium conversion coating (Alodine 1200), then primer coated with Deft 02Y040A Chromated Primer and APC Topcoat 99GY013, after a 2000 hour salt spray exposure.

Referring now to FIG. 5A, FIG. 5B and FIG. 5C, three Al-2024 panels are shown. The panel shown in FIG. 5A was coated with a lithium based conversion coatings according to an embodiment of the invention. Panel 5A was then coated with a second coating, a rare earth conversion coating RECC 3021™ (Deft, Inc.). The panel shown in FIG. 5B was coated with a non-hexavalent chromium conversion coating, and the panel shown in FIG. 5C was coated a hexavalent chromium conversion coating (Alodine 1200). All three panels were subsequently primer coated with Deft 02Y040A Chromated Primer and Deft APC Topcoat 99GY013, and subjected to a 2000 hour salt spray exposure test. As shown in FIG. 5A, the panel coated with the lithium based coating and rare earth coating (the non-chrome conversion coating according to the invention) performed as well or better, showing excellent corrosion resistance and paint adhesion, than the substrates conversion coated with chromate containing conversion coating, shown in FIGS. 5B and 5C.

Figure 6C:
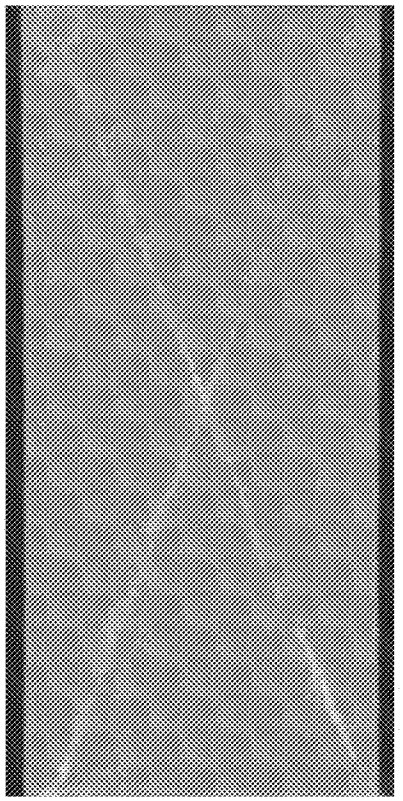
FIG. 6C is an Al2024 comparison panel conversion coated with a hexavalent chromium conversion coating (Alodine 1200), then primer coated with Deft Non-Cr Primer and Deft03GY292 Topcoat, after a 2000 hour salt spray exposure.
Figure 6B:
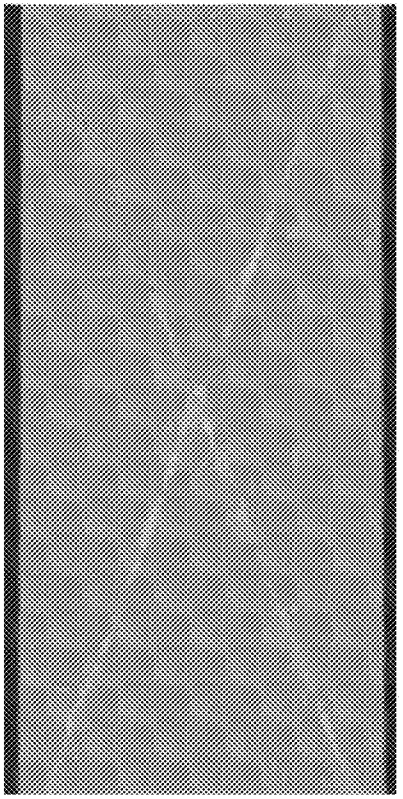
FIG. 6B is an Al2024 comparison panel conversion coated with a non-hexavalent chromium conversion coating, then primer coated with Deft Non-Cr Primer and Deft 03GY292 Topcoat, after a 2000 hour salt spray exposure.
Figure 6A:
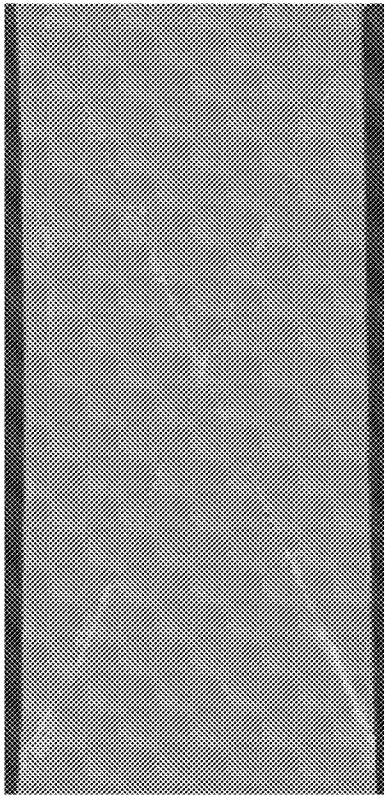
FIG. 6A is an Al2024 panel coated with a lithium based conversion coatings according to an embodiment of the invention, followed by a second coating with a rare earth conversion coating RECC 3021™ (Deft, Inc.), then primer coated with Deft Non-Cr Primer and Deft 03GY292 Topcoat, after a 2000 hour salt spray exposure.

Referring now to FIG. 6A, FIG. 6B and FIG. 6C, three Al-2024 panels are shown. The panel shown in FIG. 6A was coated with a lithium based conversion coatings according to an embodiment of the invention, followed by a second coating with a rare earth conversion coating RECC 3021™ (Deft, Inc.), then primer coated with Deft Non-Cr Primer and Deft 03GY292 Topcoat. The panel shown in FIG. 6B was conversion coated with a non-hexavalent chromium conversion coating, then primer coated with Deft Non-Cr Primer and Deft 03GY292 Topcoat. The panel shown in FIG. 6C was coated with a hexavalent chromium conversion coating (Alodine 1200), then primer coated with Deft Non-Cr Primer and Deft03GY292 Topcoat. All three panels were then subjected to a 2000 hour salt spray exposure test. As shown in FIG. 6A, the panel coated with the lithium based coating and rare earth coating (the non-chrome conversion coating according to the invention) in the non-chrome coating system performed as well or better, showing excellent corrosion resistance and paint adhesion, than the substrates conversion coated with chromate containing conversion coating, shown in FIGS. 6B and 6C.

Figures 7A, 7B, 7C:
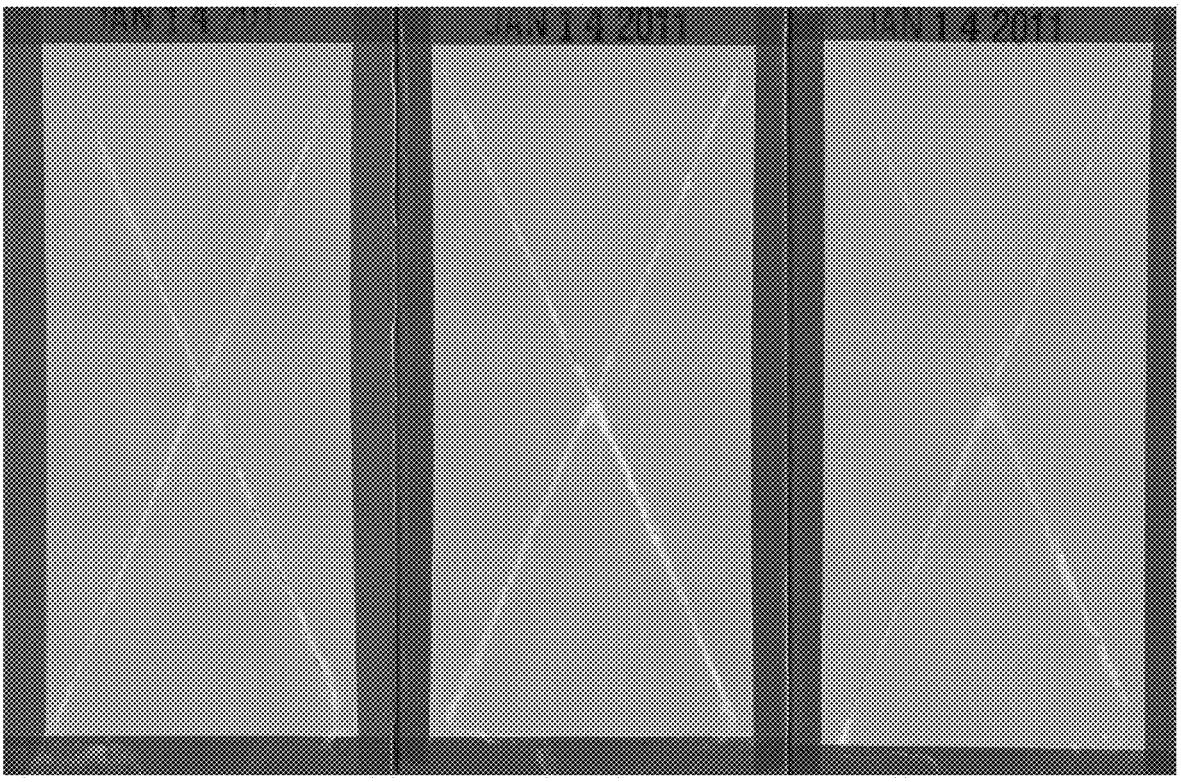
FIG. 7A is an Al2024 panel coated with a lithium based conversion coatings according to an embodiment of the invention, followed by a second coating with a rare earth conversion coating RECC 3021™ (Deft, Inc.), then primer coated with Deft Non-Cr Primer and APC Topcoat 99GY013, after a 2000 hour salt spray exposure.
FIG. 7B is an Al2024 comparison panel conversion coated with a non-hexavalent chromium conversion coating, then primer coated with Deft Non-Cr Primer and APC Topcoat 99GY013, after a 2000 hour salt spray exposure.
FIG. 7C is an Al2024 comparison panel conversion coated with a hexavalent chromium conversion coating (Alodine 1200), then primer coated with Deft Non-Cr Primer and APC Topcoat 99GY013, after a 2000 hour salt spray exposure.

Referring now to FIG. 7A, FIG. 7B and FIG. 7C, three Al-2024 panels are shown. The panel shown in FIG. 7A was coated with a lithium based conversion coatings according to an embodiment of the invention, followed by a second coating with a rare earth conversion coating RECC 3021™ (Deft, Inc.), then primer coated with Deft Non-Cr Primer and APC Topcoat 99GY013. The panel shown in FIG. 7B was coated with a non-hexavalent chromium conversion coating, then primer coated with Deft Non-Cr Primer and APC Topcoat 99GY013. The panel shown in FIG. 7C was conversion coated with a hexavalent chromium conversion coating (Alodine 1200), then primer coated with Deft Non-Cr Primer and APC Topcoat 99GY013. All three panels were subjected to a 2000 hr salt spray exposure test. As shown in FIG. 7A, the panel coated with the lithium based coating and rare earth coating (the non-chrome conversion coating according to the invention) in the non-chrome coating system performed as well or better, showing excellent corrosion resistance and paint adhesion, than the substrates conversion coated with chromate containing conversion coating, shown in FIGS. 7B and 7C.

According to a preferred process for coating the metal substrate, the metal substrate is coated with a lithium based coating composition according to the present invention. Next, the coated metal substrate is allowed to dry or partially dry at room temperature, followed by an optional rinse step. In a final step of the coating process, the metal substrate may be coated with a rare earth coating composition, such as disclosed in U.S. Pat. No. 7,452,427 (Morris). However, other coatings capable of forming a precipitate upon a change in pH may be used, such as but not limited to those known in the art, including trivalent chrome, such as Alodine 5900; zirconium, such as Alodine 5700; sol gel coatings, such as Boegel and AC 131; cobalt coatings; vanadate coatings; molybdate coatings; permanganate coatings; and the like, as well as combinations, such as but not limited to Y and Zr, including RECC 3012, commercially available from Deft, Inc. A final rinse is not required prior to subsequent painting or primer coatings. As described herein, as the lithium based coating composition is alkaline, a prior deoxidizing and/or degreasing step is not required, and the lithium based coating composition may be used as a 1-step substitute for the four-step: 1) degreasing; 2) deoxidizing; 3) rinsing; and 4) conversion coating processes disclosed in the prior art. Further, the lithium based coating composition according to the present invention may be applied and dried (or partially dried) at room temperature. Applying the coating at an elevated temperature and/or drying the coated substrate at an elevated temperature is not required. Also, a final rinse of the coated substrate is not required to achieve corrosion resistance on the substrate. Thus, the present invention achieves significant cost savings to a manufacturer in labor and materials costs by reducing a seven step process, taught in the prior art, e.g., 1) degreasing; 2) deoxidizing; 3) rinsing; 4) conversion coating application; 5) rinsing and/or drying at elevated temperature; 6) sealing; and 7) final rinsing step to a three step process: 1) coating with the lithium based composition of the present invention; 2) optional no drying, or a room temp drying, or a partial drying at room temperature, and/or 3) coating with a rare earth coating, without rinsing steps.

Prior art coatings containing lithium are known. However, these coatings provide unsuitable corrosion resistance and/or require industrially unfavorable steps in the coating process. The prior art coatings comprising lithium based compositions having phosphoric acid are not suitable in the present invention as the compositions of the present invention have an alkaline pH, and the added advantage of omitting the degreasing/deoxidizing step. It is believed that phosphates have not been used readily in prior art compositions as they will readily precipitate in solution if sodium phosphate is used as the source of the phosphorus. Accordingly, in preferred embodiments, the ratios of reactants are limited such that reaction is limited only to the surface of the metal, resulting in a novel/desirable Li coating on a metal surface. The final step in the coating process, with a precipitable metal such as Zr, Cr, Co, V, etc., or subsequent Li-containing solution, and preferably a rare earth composition containing Ce and/or Y, results in a metal substrate with corrosion resistance comparable to that of chromate based coatings.

The prior art also teaches conversion coatings that are applied at elevated temperatures and/or that the coating is cured by heating, and further discloses that additional rinsing steps are needed to achieve acceptable results. In addition, the prior art teaches that the substrates should be degreased and deoxidized to achieve corrosion resistance. The lithium based conversion coatings described herein are alkaline based and pre-treatment steps such as deoxidizing and/or degreasing steps may be omitted in the treatment process. Further, the coatings may be applied at room temperature, with optional room temperature drying or partial drying before the second "curing" step with a rare earth element coating composition. An intermediate rinsing step is not required to achieve corrosion resistance comparable to that of known chromate based coating systems. Accordingly, the lithium based coatings disclosed herein are a viable alternative to chromate based coatings in the industry.

As described herein and shown in the accompanying Figures, the lithium based coating has significant advantages over known prior art coating compositions. For example, in certain embodiments of the invention, the lithium based coating is not rinsed prior to subsequent coatings, but let dry at room temperature, resulting in reduced labor costs for application. Also, as shown in FIG. 1B, certain embodiments of the invention can result in a self-healing characteristic. Further, as demonstrated in the above-described Figures, a non-chromium based conversion coating has been formulated which has been demonstrated to perform as well, or better than chrome based conversion coatings, showing excellent corrosion resistance and paint adhesion. The lithium based coatings according to the invention also exhibit storage stability, performance and paint adhesion. As shown in the following Examples, the lithium based conversion coatings according to the invention, perform up to 2 weeks, unpainted, in a salt spray exposure test, with less than 3 pits with or without tails on a 3×6 area on an Al-2024 test panel. These results demonstrate the industrial feasibility of the lithium based coatings as a non-chrome conversion coating alternative to environmentally undesirable chrome containing conversion coating. No other literature is known which reports such performance in a 2-week salt spray test.

The invention will be further described by reference to the following non-limiting examples, which are offered to further illustrate various embodiments of the present invention. It should be understood, however, that many variations and modifications can be made while remaining within the scope of the present invention.

EXAMPLES

Example 1. Preparation of Lithium Based Coating Compositions

The following example and formulas demonstrate the general procedures for preparation of the lithium based coating compositions, metal substrate preparation, and application of the coating compositions to the metal substrate. However, other formulations and modifications to the following procedures can be used according to the present invention as will be understood by those of skill in the art with reference to this disclosure.

A. Composition Formulations.

According to one embodiment, the composition comprises a lithium based composition having lithium, hydroxide, and phosphate ions in an aqueous solution, and optionally one or more additional Group IA metal ions, and/or carbonate ions. The lithium based coating compositions were prepared with the amounts of ingredients shown in Formulas I-VO.

FORMULA I

| Ingredient | Min | Max | Preferred |
|---|---|---|---|
| $Li_2CO_3$ | 0.05 g | Sol. Limit; approx. 12 g | 2.0 g |
| NaOH | 0.25 g | 16 g | 2.0 g |
| $Na_3PO_4$—$12H_2O$ | 0.25 g | 16 g | 2.0 g |
| Surfactant Dynol 604 | 0.003 g | 0.5 g | 0.015 g |
| Water | Balance | balance | balance |
| Total | 1000 g | 1000 g | 1000 g |

The lithium based coating compositions according to Formula I were prepared by dissolving the desired amount of the Li compound separately in a suitable container. The sodium hydroxide and sodium phosphate compounds are also dissolved together in a suitable container, separate from the Li compound. Once fully dissolved, the two solutions are mixed together, preferably by adding the Li solution to the phosphate and hydroxide solution. Once mixed, the surfactant is added. The lithium based coatings according to Formula I comprise lithium carbonate, sodium hydroxide and sodium phosphate, and preferably, a surfactant. The coatings according to Formula I exhibit good adhesion to the metal substrate.

FORMULA II

| Ingredient | Min | Max | Preferred |
|---|---|---|---|
| $Li_2CO_3$ | 0.05 g | 12 g | 2.0 g |
| NaOH | 0.25 g | 16 g | 2.0 g |
| $Na_3PO_4$—$12H_2O$ | 0.25 g | 16 g | 2.0 g |
| Polyvinylpyrrolidone | 0.003 g | 5 g | 0.2 g |
| Surfactant Dynol 604 | 0.003 g | 0.5 g | 0.015 g |
| Water | Balance | balance | balance |
| Total | 1000 g | 1000 g | 1000 g |

The lithium based coating compositions according to Formula II were prepared by dissolving the desired amount of the Li compound separately in a suitable container. The sodium hydroxide and sodium phosphate compounds are also dissolved together in a suitable container, separate from the Li compound. Once fully dissolved, the two solutions are mixed together, preferably by adding the Li solution to the phosphate and hydroxide solution. Once mixed, the polyvinylpyrrolidone was stirred into the solution. Once fully dissolved, the surfactant is added. The lithium based coatings according to Formula II comprise lithium carbonate, sodium hydroxide and sodium phosphate, and preferably, a surfactant and polyvinylpyrrolidone. The coatings according to Formula II exhibit good adhesion to the metal substrate.

| FORMULA III | | | |
|---|---|---|---|
| Ingredient | Min | Max | Preferred |
| LiOH | 0.05 g | 16 g | 1.15 g |
| $LiH_2PO_4$ | 0.05 g | 16 g | 0.2 g |
| Surfactant Dynol 604 | 0.003 g | 0.5 g | 0.015 g |
| Water | Balance | balance | balance |
| Total | 1000 g | 1000 g | 1000 g |

The lithium based coating compositions according to Formula III were prepared by dissolving the desired amount of the lithium hydroxide separately in a suitable container. The lithium phosphate was also dissolved in a separate container from the lithium hydroxide. Once fully dissolved, the two solutions are mixed together, preferably by adding the hydroxide solution to the phosphate solution. Once mixed, the surfactant is added. The lithium based coatings according to Formula III comprise lithium hydroxide and lithium di-hydrogen phosphate, and preferably, a surfactant. The coatings according to Formula III exhibit good adhesion to the metal substrate.

| FORMULA IV | | | |
|---|---|---|---|
| Ingredient | Min | Max | Preferred |
| LiOH | 0.05 g | 12 g | 2.0 g |
| $Na_4P_2O_7$—10 $H_2O$ (sodium pyrophosphate) | 0.25 g | 16 g | 2.0 g |
| Surfactant Dynol 604 | 0.003 g | 0.5 g | 0.015 g |
| Water | Balance | balance | balance |
| Total | 1000 g | 1000 g | 1000 g |

The lithium based coating compositions according to Formula IV were prepared by dissolving the desired amount of the Li compound separately in a suitable container. The sodium pyrophosphate was dissolved in a suitable container, separate from the Li compound. Once fully dissolved, the two solutions are mixed together, preferably by adding the Li solution to the pyrophosphate solution. Once mixed, the surfactant is added. Optionally, depending upon the ratio, the Li compound and the sodium pyrophosphate may be dissolved in the same container. Once fully dissolved, the surfactant is added. Lithium based coatings according to Formula IV comprise lithium hydroxide and sodium pyrophosphate, and preferably, a surfactant. The coatings according to Formula IV exhibit good adhesion to the metal substrate.

| FORMULA V | | | |
|---|---|---|---|
| Ingredient | Min | Max | Prefered |
| LiOH | 0.05 g | 12 g | 2.0 g |
| $Na_3PO_4$—$12H_2O$ | 0.25 g | 16 g | 2.0 g |
| Surfactant Dynol 604 | 0.003 g | 0.5 g | 0.015 g |
| Water | Balance | balance | balance |
| Total | 1000 g | 1000 g | 1000 g |

The lithium based coating compositions according to Formula V were prepared by dissolving the desired amount of the Li compound separately in a suitable container. Though the two salts may be dissolved together in the same container, longer storage stability is obtained when the sodium phosphate was dissolved in a suitable container, separate from the Li compound. Once fully dissolved, the two solutions are mixed together, preferably by adding the Li solution to the phosphate solution. Once mixed, the surfactant is added. The lithium based coatings according to Formula V comprise lithium hydroxide and sodium phosphate, and preferably, a surfactant. The coatings according to Formula V exhibit good adhesion to the metal substrate.

According to another embodiment, the composition comprises a lithium based composition having lithium, hydroxide, and fluoride ions in solution. The composition may optionally have one or more additional Group IA metal ions. Examples of compositions according to this embodiment include the following formula:

| FORMULA VI | | | |
|---|---|---|---|
| Ingredient | Min | Max | Preferred |
| LiOH | 0.05 g | 16 g | 1.15 g |
| NaF | .05 g | 10 g | 0.5 g |
| Surfactant Dynol 604 | 0.003 g | 0.5 g | 0.015 g |
| Water | Balance | balance | balance |
| Total | 1000 g | 1000 g | 1000 g |

The lithium based coating compositions according to Formula VI were prepared by dissolving the desired amount of the Li compound and sodium fluoride in the same container. Once fully dissolved, the surfactant is added. The lithium based coatings according to Formula VI comprise lithium hydroxide and sodium fluoride, and preferably, a surfactant. The coatings according to Formula V exhibit good adhesion to the metal substrate.

It is specifically noted that in each of the above formulations, the potassium K+ version may be substituted for all Na+ compounds, e.g., potassium hydroxide (KOH) for sodium hydroxide (NaOH).

According to other embodiments, the lithium based coatings according to the invention may additionally comprise one or more of the following ingredients in the following amounts, as shown in Table 1.

TABLE 1

| Composition Optional Components. | | | |
|---|---|---|---|
| Ingredient | Min | Max | Preferred |
| Chelators, such as EDTA, TEA, citric acid, etc. | 0.003 g | 5 g | 0.2 g |
| Hexamethylenetetramine (another chelator) | 0.003 g | 5 g | 0.2 g |
| Allantoin | 0.003 g | 5 g | 0.2 g |
| Polyvinylpyrrolidone | 0.003 g | 5 g | 0.2 g |
| $K_2CO_3$ | 0.05 g | 12 g | 2 g |
| 2,5-Dimercapto-1,3,4-thiadiazole | 0.003 g | 5 g | 0.2 g |
| Thiourea (Another chelator) | 0.003 g | 5 g | 0.2 g |
| Alcohol—Ethanol, Isopropyl, etc | 0.25 g | 16 g | 2.0 g |

B. Metal Substrate (Panel) Preparation:

The metal substrates were typically solvent wiped to remove inks and oils prior to application. For an immersion processes, the metal substrate was optionally degreased using a suitable degreaser, such as the previously mentioned Turco 4215 NCLT and deoxidized using a suitable deoxidizer, such as the previously mentioned Amchem 7. The operating times and temperatures for each degreasing and deoxidizing step were in accordance with the manufacturer's guidelines. The metal substrates were then immersed or spray coated in the compositions above for several seconds to several hours, more preferably from 1 to 10 minutes, most preferably for 3 minutes. The metal substrates were then allowed to dry at ambient temperature. Optionally, the metal substrates were subsequently conversion coated with or without rinsing prior and or post.

For spray, brush, and pen applications, the metal substrates were treated using the exemplary formulas by applying the solution and keeping the surface saturated by additional applications as necessary, for several seconds to several hours, more preferably from 1 to 10 minutes, most preferably for 3 minutes. The metal substrates were then allowed to dry. Optionally, the metal substrates were subsequently conversion coated with or without rinsing prior and or post.

For spray, brush, and pen applications, the metal substrates were optionally solvent wiped, then treated using the exemplary formulas by applying the solution and keeping the surface saturated by additional applications as necessary, for several seconds to several hours, more preferably from 1 to 10 minutes, most preferably for 3 minutes. The metal substrates were then allowed to dry. Optionally, the metal substrates were subsequently conversion coated with or without rinsing prior and or post.

For spray, brush, and pen applications, the metal substrates were optionally abraded using Scotch-Brite pads, wet-wiped to remove any oxide/smut that formed, rinsed, then treated using the exemplary formulations above. The metal substrates were treated using the exemplary formulas by applying the solution and keeping the surface saturated by additional applications as necessary, for several seconds to several hours, more preferably from 1 to 10 minutes, most preferably for 3 minutes. The metal substrates were then allowed to dry. Optionally, the metal substrates were subsequently conversion coated with or without rinsing prior and/or post.

C. Application Procedure:

The lithium based coating composition, prepared as described above, was applied to the metal substrate using a spray process. After application of the coating, the coated substrate was allowed to dry at ambient temperature. Some coatings were subsequently conversion coated with and without rinses prior and post. Painted panels were allowed to air dry for 4 to 48 hours prior to application of a primer or subsequent paint.

D. Panel Testing.

The following test results were preformed on the test panels indicated in the following tables. Coating compositions were prepared with the amount of ingredient indicated the in following tables and prepared according to the above Examples. The test panels were rated according to one of the ELM Scale, the Boeing Degree of Failure for Scribed Wet Tape Adhesion Test, or the Keller Corrosion Rating Scale.

ELM Scale

Performance Codes:

| | |
|---|---|
| 10 | Identical to how it went into test |
| 9 | Passes MIL-C-5541 and MIL-C-81706 with less than or equal to 3 pits (with or without tails) per 3" × 6" panel |
| 8 | Passes MIL-C-5541 with less than or equal to 3 pits with white corrosion tails (Discoloring tails okay) per 3" × 6" panel |
| 7 | >3 pits with tails ≤15 pits total |
| 6 | >15 pits total and <40 pits total |
| 5 | 30% of surface is corroded |
| 4 | 50% of surface is corroded |
| 3 | 70% of surface is corroded |
| 2 | 85% of surface is corroded |
| 1 | 100% of surface is corroded |

Boeing Degree of Failure for Scribed Wet Tape Adhesion Test P.S. 21313

| | |
|---|---|
| 5 | Pass - No Loss of Coating Along Scribe Lines |
| 4 | Pass - Slight Loss of Coating, Trace Peeling, or Removal Along Scribe Lines |
| 3 | Pass - Up to 1/32 Inch Coating Loss Beyond Scribe Lines. Retest |
| 2 | Failure - Jagged Coating Loss Beyond Scribe Lines Greater Than 1/32 Inch |
| 1 | Failure - Coating Removal From Most of the Test Area |
| 0 | Failure - Gross Coating Removal in the Test Area and Beyond the Test Area |

Keller Corrosion Rating Scale (Boeing-St. Louis).

| Corrosion Activity: | Scribe Line Activity |
|---|---|
| 1. Scribe line beginning to darken or shiny scribe. | A. No creepage. |
| 2. Scribe lines >50% darkened. | B. 0 to 1/64" |
| 3. Scribe line dark. | C. 1/64 to 1/32" |
| 4. Several localized sites of white salt in scribe lines. | D. 1/32 to 1/16" |
| 5. Many localized sites of white salt in scribe lines. | E. 1/16 to 1/8" |
| 6. White salt filling scribe lines. | F. 1/8 to 3/16" |
| 7. Dark corrosion sites in scribe lines. | G. 3/16 to 1/4" |
| 8. Few blisters under primer along scribe line. (<12) | H. 1/4 to 3/8" |
| 9. Many blisters under primer along scribe line. | |
| 10. Slight lift along scribe lines. | |
| 11. Coating curling up along scribe. | |
| 12. Pin point sites/pits of corrosion on organic coating surface (1/16" to 1/8" dia.). | |
| 13. One or more blisters on surface away from scribe. | |
| 14. Many blisters under primer away from scribe. | |
| 15. Starting to blister over surface. | |

Example 2. Comparison of Phosphate/No Added Phosphate Coatings on Test Panels Table 2 below shows a comparison of Li formulations prepared according to the present invention with and without added phosphate. Panels 2A-2W (bare 2024-T3 aluminum alloy panels), were prepared using the coating composition preparation procedure described in Example 1 with the formulations shown in Table 2.

The coating compositions were applied by spray coating for a deposition time of from between 1 minute (1 m) to about 5 minutes (5 m) each, as indicated in Table 2. The panels were subjected to a 2 day salt spray test (2 Day SS) and scored according to the ELM Scale rating scale, with 10 being the highest level performance (identical to how it went into the test) and 1 being the lowest (100% corroded).

As shown in Table 2, compositions comprising lithium carbonate in the absence of phosphate showed much higher corrosion (rated from 4 to 6) on the ELM Scale with compositions comprising lithium carbonate and a phosphate ranking significantly higher (from 8 to 10) on the ELM scale. Compositions that score 9 or better on the ELM scale pass military specifications MIL-C-5541E (Military Specification for Chemical Coatings on Aluminum and Aluminum Alloys) and MIL-C-81706 (Military Specification for Chemical Conversion Materials for Coating Aluminum and Aluminum Alloys). This is a significant achievement as it is not believed that there are currently any chrome free coatings in commercial production which rate a nine or a ten on the ELM scale.

TABLE 2

Comparison Panels With And Without Added Phosphate.

| Panel No. | NaOH | $Na_3PO_4$ | $Na_4P_2O_7$ | $Li_2CO_3$ | Abraded | Surfactant | App I | Time I | 2 day SS[1] |
|---|---|---|---|---|---|---|---|---|---|
| 2A | | | | 0.6 | No | 0 | Spray | 1 m | 5 |
| 2B | | | | 0.6 | No | 0 | Spray | 5 m | 6 |
| 2C | | | | 0.2 | No | 0 | Spray | 3 m | 4 |
| 2D | | | | 0.4 | No | 0 | Spray | 3 m | 4 |
| 2E | 0.8 | 0.8 | | 0.2 | No | 0 | Spray | 3 m | 7 |
| 2F | 0.8 | 0.8 | | 0.3 | No | 0 | Spray | 3 m | 10 |
| 2G | 1.3 | 0.3 | | 0.2 | No | 0 | Spray | 3 m | 9 |
| 2H | 0.8 | 0.8 | | 0.2 | No | 0 | Spray | 3 m | 10 |
| 2I | 0.8 | 0.8 | | 0.3 | No | 0 | Spray | 3 m | 10 |
| 2J | 0.8 | 0.8 | | 0.6 | No | 0 | Spray | 3 m | 10 |
| 2K | 0.4 | 0.4 | | 0.6 | No | 0 | Spray | 1 m | 9 |
| 2L | 0.4 | 0.4 | | 0.6 | No | 0 | Spray | 5 m | 9 |
| 2M | 0.2 | 0.4 | | 0.2 | No | 0.03 | Spray | 3 m | 9 |
| 2N | 0.4 | 0.8 | | 0.2 | No | 0.03 | Spray | 3 m | 10 |
| 2O | 0.4 | 0.2 | | 0.1 | Yes | 0.03 | Spray | 2 m | 9 |
| 2P | 0.4 | 0.4 | | 0.2 | Yes | 0.03 | Spray | 2 m | 8 |
| 2Q | 0.2 | 0.2 | | 0.1 | Yes | 0.03 | Spray | 2 m | 8 |
| 2R | 0.2 | 0.2 | | 0.2 | Yes | 0.03 | Spray | 2 m | 9 |
| 2S | 0.4 | 0.2 | | 0.2 | Yes | 0.03 | Spray | 2 m | 9 |
| 2T | 0.4 | 0.8 | | 0.2 | Yes | 0.03 | Spray | 2 m | 10 |
| 2U | 0.8 | 0.8 | | 0.2 | Yes | 0.03 | Spray | 2 m | 10 |
| 2V | 0.4 | 0.8 | | 0.3 | Yes | 0.03 | Spray | 2 m | 10 |
| 2W | 0.4 | | 0.8 | 0.2 | Yes | 0.03 | Spray | 2 m | 10 |

[1]Two Days Salt Spray Rating Per ELM Scale

Example 3. Comparison of Phosphate and Lithium Carbonate Compositions with Varying Concentration on Test Panels Table 3 below shows a comparison of Li formulations prepared according to the present invention. Each of the formulations prepared for Example 3 comprised a combination of carbonate and phosphate. Panels 3A-3I (bare 2024-T3 aluminum alloy panels) were prepared using the coating composition preparation procedure described in Example 1 with the formulations shown in Table 3.

The coating compositions were applied by spray coating for a deposition time of 2 minutes each, as indicated in Table 3. The panels were subjected to a 2 day salt spray test (2 Day SS) and scored according to the ELM Scale rating scale, with 10 being the highest level performance (identical to how it went into the test) and 1 being the lowest (100% corroded). The panels were then primer coated as indicated below and "dry" cured. The paint was scratched dry and tape was pulled across. The panels were then soaked in water for 24 hrs wiped, taped, and pulled, according to Boeing P.S. 21313. All phosphate containing compositions passed.

As shown above in Table 2, Example 2, compositions comprising a combination of lithium and phosphate showed much higher corrosion resistance, ranking from 8 to 10 on the ELM scale. The compositions prepared and tested, as shown below in Table 3, show that higher concentrations of carbonate and phosphate increase corrosion resistance, and all of the compositions containing a combination of lithium carbonate and phosphate passed on the Boeing P.S. 21313 scale, and compositions with higher concentration of phosphate showed a 10 rating.

TABLE 3

Primer Adhesion and Salt Spray Exposure Tests

| Panel | Surfactant | NaOH | $Na_3PO_4$ | $Na_4P_2O_7$ | $Li_2CO_3$ | Abraded | App I | Time I | 2 day SS[1] | Dry* | Wet* |
|---|---|---|---|---|---|---|---|---|---|---|---|
| 3A | 0.03 | 0.2 | 0.2 | | 0.05 | Yes | Spray | 2 m | 6 | Pass | Pass |
| 3B | 0.03 | 0.2 | 0.2 | | 0.1 | Yes | Spray | 2 m | 8 | Pass | Pass |
| 3C | 0.03 | 0.2 | 0.2 | | 0.2 | Yes | Spray | 2 m | 9 | Pass | Pass |
| 3D | 0.03 | 0.4 | 0.2 | | 0.05 | Yes | Spray | 2 m | 7 | Pass | Pass |
| 3E | 0.03 | 0.4 | 0.2 | | 0.1 | Yes | Spray | 2 m | 8 | Pass | Pass |
| 3F | 0.03 | 0.4 | 0.2 | | 0.2 | Yes | Spray | 2 m | 9 | Pass | Pass |
| 3G | 0.03 | 0.4 | 0.8 | | 0.2 | Yes | Spray | 2 m | 10 | Pass | Pass |
| 3H | 0.03 | 0.4 | 0.8 | | 0.3 | Yes | Spray | 2 m | 10 | Pass | Pass |
| 3I | 0.03 | 0.4 | | 0.8 | 0.2 | Yes | Spray | 2 m | 10 | Pass | Pass |

Example 4. Paint Adhesion for Phosphate and Lithium Carbonate Compositions with Varying Concentration on Various Aluminum/Aluminum Alloy Test Panels Table 4 below shows a comparison of Li formulations prepared according to the present invention. Each of the formulations prepared for Example 4 comprised a combination of lithium carbonate, hydroxide and phosphate. Panels 4A-4FF, where the panels substrate is indicated in Table 4, were prepared using the coating composition preparation procedure described in Example 1 with the formulations shown in Table 4.

The substrate was abraded before application of App I. The coating compositions (App I) were applied by spray coating for a deposition time of 2 minutes (2 m) to 5 minutes (5 m) each, as indicated in Table 4. The panels were then dried at ambient temperature (App II). An optional rinse application with tap water (tap rinse), was then applied to some of the panels as indicated in Table 4. The final coating applied to the panels was non-chrome rare earth conversion coating (RECC 3021™, Deft, Inc.) which was applied as indicated in Table 4.

The panels were then primer coated as indicated in Table 4 and "dry" cured. The paint was scratched dry and tape was pulled across. The panels were then soaked in water for 24 hrs wiped, taped, and pulled, according to Boeing P.S. 21313 Coating Adhesion Tests, Dry and Wet Tape Tests (Boeing, St. Louis, Mo.). All phosphate containing compositions passed, indicating the suitability of the compositions for use on a variety of substrates, that variability of the application time of the lithium based composition did not affect performance, and the viability of the compositions of the invention in an all chrome free coating and primer system.

Example 5. Phosphate and Lithium Carbonate Compositions after Seven Day Salt Spray Test Table 5 below shows a comparison of Li formulations prepared according to the present invention. Each of the formulations prepared for Example 5 comprised a combination of lithium carbonate, hydroxide and phosphate. Panels 5A-5D, (bare 2024-T3 aluminum alloy panels), were prepared using the coating composition preparation procedure described in Example 1 with the formulations shown in Table 5.

The substrate was abraded before application of the lithium based conversion coating. The coating compositions (were applied by spray coating for a deposition time of 5 minutes (5 m) each, as indicated in Table 5. The panels were then dried at ambient temperature (App II). The final coating applied to the panels was non-chrome rare earth conversion coating (RECC 3021™, Deft, Inc.) which was applied as indicated in Table 5.

The panels were then tested under a 7-day salt spray exposure test and rated on the All phosphate containing compositions passed, indicating the suitability of the compositions for use on a variety of substrates, that variability of the application time of the lithium based composition did not affect performance, and the viability of the compositions of the invention in an all chrome free coating and primer system.

Example 6. Phosphate and Lithium Carbonate Compositions with Varying Application Time after 2 Day Salt Spray Test, Rated Per ELM Scale Table 6 below shows a comparison of Li formulations prepared according to the present invention. Each of the formulations prepared for Example 6 comprised a combination of lithium carbonate, hydroxide and phosphate. Panels 6A-6I, (bare 2024-T3 aluminum alloy panels), were prepared using the coating composition preparation procedure described in Example 1 with the formulations shown in Table 6.

The substrate was abraded before application of the lithium based conversion coating. The coating compositions (were applied by spray coating for a deposition time of between 10 seconds (10 sec) and 5 minutes (5 m) each, as indicated in Table 6. The panels were then dried at ambient temperature. The panels were then rinsed in tap water as indicated in Table 6. Some of the panels were then further coated with a non-chrome rare earth conversion coating (RECC 3021™, Deft, Inc.) which was applied as indicated in Table 6.

The panels were then tested under a 2-day salt spray exposure test and rated on the ELM scale. All panels passed with at least a 9 rating, indicating that variability of the application time of the lithium based composition did not affect performance, and the viability of the compositions of the invention in an all chrome free coating and primer system.

Example 7. Phosphate and Lithium Carbonate Compositions Applied to Varying Aluminum Alloys with a Chrome Free Primer, Subjected to 1,000 hr Salt Spray Table 7 below shows a comparison of Li formulations prepared according to the present invention. Each of the formulations prepared for Example 7 comprised a combination of lithium carbonate, hydroxide and phosphate. Panels 7A-7D, each a various aluminum alloy as indicated in Table 7, were prepared using the coating composition preparation procedure described in Example 1 with the formulations shown in Table 7.

The substrate was abraded before application of the lithium based conversion coating. The coating compositions were applied by spray coating for a deposition time of 3 minutes (3 m) each, as indicated in Table 7. The panels were then dried at ambient temperature. The panels were then rinsed in tap water as indicated in Table 7 (App III). The panels were then further coated with a non-chrome rare earth conversion coating (RECC 3021™, Deft, Inc.) which was applied as indicated in Table 7. The final application to the panels was a chrome free primer, 02GN093 (Deft, Inc.).

The panels were then tested under a 1,000 hr salt spray exposure test and rated on the Keller Corrosion Rating Scale. All panels passed with at least a 1, 4 A rating, indicating the suitability of the coatings on various alloys and the viability of the compositions of the invention in an all chrome free coating and primer system.

Example 8. Phosphate and Lithium Carbonate Compositions Applied to Al 2024 with a Chrome Free Primer, Subjected to 2,000 hr Salt Spray Table 8 below shows a comparison of Li formulations prepared according to the present invention. Each of the formulations prepared for Example 8 comprised a combination of lithium carbonate, hydroxide, phosphate, surfactant and allantion. Panels 8A-8K were prepared using the coating composition preparation procedure described in Example 1 with the formulations shown in Table 8.

The Al 2024 substrates were abraded before application of the lithium based conversion coating. The coating compositions were applied by spray coating for a deposition time of between 1 minute (1 m) and 5 minutes (5 m) each, as indicated in Table 8. The panels were then dried at ambient temperature for a time ranging between 7 to 10 minutes (7 m-10 m). The panels were then rinsed in tap water as indicated in Table 8 for 5 minutes (5 m) (App III). The panels were then further coated with a non-chrome rare earth conversion coating (RECC 3021™, Deft, Inc.) which was applied as indicated in Table 8. The final application to the panels was a chrome free primer, 02GN093 (Deft, Inc.).

The panels were then tested under a 2,000 hr salt spray exposure test and rated on the Keller Corrosion Rating Scale. All panels but one passed with at least a 1, 5 rating for corrosion activity (the exception being one 2,5 corrosion activity rating), and an A rating for all panels for scribe line creepage, indicating the superior corrosion resistance of an all chrome free system and the suitability of the coatings for military applications (shown by the longer 2,000 salt spray test).

Example 9. Comparison of Cr Conversion Coated and Various Li—P/Carbonate Compositions Applied to Al 2024, Subjected to 7 and 14 Day Salt Spray Table 9 below shows various Li—P formulations prepared according to the present invention. Each of the formulations prepared for Example 9 comprised a combination of lithium, hydroxide, and phosphate ions in solution, as well as a surfactant, and optionally carbonate ions and/or PVP. Panels 9A-9B were prepared using the coating composition preparation procedure described in Example 1 with the formulations shown in Table 9, which included lithium carbonate and PVP. Panels 9F-9I were prepared using the coating composition preparation procedure described in Example 1 with the formulations shown in Table 9. The coating composition prepared and applied to panel 8F additionally comprised lithium carbonate. Chromium control panels 9C-9E, and 9J-9M were also prepared and tested. Panels 9C-9E and 9J-9M were coated with a chromium based conversion coating, Alodine® 1200 or Alodine® 600, commercially available from Henkel Corp.

The Al 2024 substrates were optionally abraded (Panels 9A-9C and 9F) before application of the lithium based conversion coating. The Li based coating compositions were applied by spray coating for a deposition time of 3 minutes (3 m) each, as indicated in Table 9. The panels were then dried at ambient temperature for 7 minutes (7 m). The panels were then optionally rinsed in tap water in tap water or as indicated in Table 9. The panels were then further coated with a non-chrome rare earth conversion coating (RECC 3021™, Deft, Inc.) which was applied as indicated in Table 9.

The panels were then tested under a 7 or 14 day salt spray exposure test and rated on the ELM Scale, with some of the panels being removed after a 7 day salt spray exposure for comparison. All of the panels coated which were coated with a lithium based coating, followed by treatment with a rare earth conversion coating, were rated at least 8 or higher on the ELM scale. Panel 8F, which was not further treated with a rare earth conversion coating, received a 6 rating on the ELM scale. The non-chrome treated panels performed as well or better than the panels treated with a chromium based conversion coating (Alodine), a current industry standard. These comparison tests indicate the superior corrosion resistance of an all chrome free system and the suitability of the coatings for military applications (shown by the longer 7 and 17 day salt spray tests).

Referring now to FIG. 8 and FIG. 9, Li—P and Chromate coated alloy test panels described in Example 9, and detailed in Table 9 are shown after the 7 and 14 day salt spray tests are shown. FIG. 8 shows Panels 8A and 8B, in the top row of panels, labeled as ELM-109-13C and ELM-109-13C, respectively. The Cr Control Panels, 8C (labeled ELM-109-37C), 8D (labeled ELM-109-38C) and 8D (labeled ELM-109-39C) are shown in the bottom row of test panels. Test panel 8F, the comparison panel not further coated with a rare earth conversion coating, is also shown in the top row of panels in FIG. 8. As shown in FIG. 8, panels ELM-109-13C and ELM-109-13C (8A & 8B), coated with a lithium based phosphate coating, followed by a chrome free rare earth conversion coating, passed the 14 day salt spray test with ≤3 Pits, which are comparable or better results than the chromate panels 8C-8D, shown in the lower row of FIG. 8. The panel labeled ELM-109-25D, shown for comparison, is a lithium based coatings according to Formula VI having lithium and a fluoride.

Referring again to FIG. 9, Panels 8G-8I, labeled as ELM-130-14-ELM-130-16, respectively, are shown. The Cr Control Panels, 8J (labeled ELM-130-135) and 8L (labeled ELM-130-131) are also shown in FIG. 9 for comparison. As shown in FIG. 8, panels ELM-130-14-ELM-130-16, coated with a lithium based phosphate coating, followed by a chrome free rare earth conversion coating, passed the 14 day salt spray test with ≤3 Pits, which are comparable or better results than the chromate panels 8J and 8J (ELM-130-135 and ELM-130-131).

TABLE 4

Summary of Paint Adhesion for Various Conversion Coated Li—P Coatings Rated Per Boeing P.S. 21313

| | | App I[1] | | | | | | | Time | | Time | | Time | | |
|---|---|---|---|---|---|---|---|---|---|---|---|---|---|---|---|
| Panel | Substrate | NaOH | $Na_3PO_4$ | $Li_2CO_3$ | PVP | Surfactant | Time I | App II | II | App III | III | App IV | IV | Dry** | Wet** |
| 4A | 6061 | 0.4 | 0.4 | 0.4 | 0.1 | 0.003 | 2 m | dry | 10 m | RECC 3021 | 5 m | | | Pass | Pass |
| 4B | 7075 | 0.4 | 0.4 | 0.4 | 0.1 | 0.003 | 2 m | dry | 10 m | RECC 3021 | 5 m | | | Pass | Pass |
| 4C | Clad 2024 | 0.4 | 0.4 | 0.4 | 0.1 | 0.003 | 2 m | dry | 10 m | RECC 3021 | 5 m | | | Pass | Pass |
| 4D | 2024 | 0.4 | 0.4 | 0.4 | 0.1 | 0.003 | 2 m | dry | 10 m | RECC 3021 | 5 m | | | Pass | Pass |
| 4E | 6061 | 0.4 | 0.4 | 0.4 | 0.1 | 0.003 | 5 m | dry | 10 m | RECC 3021 | 5 m | | | Pass | Pass |
| 4F | 7075 | 0.4 | 0.4 | 0.4 | 0.1 | 0.003 | 5 m | dry | 10 m | RECC 3021 | 5 m | | | Pass | Pass |
| 4G | Clad 2024 | 0.4 | 0.4 | 0.4 | 0.1 | 0.003 | 5 m | dry | 10 m | RECC 3021 | 5 m | | | Pass | Pass |
| 4H | 2024 | 0.4 | 0.4 | 0.4 | 0.1 | 0.003 | 5 m | dry | 10 m | RECC 3021 | 5 m | | | Pass | Pass |
| 4I | 6061 | 0.4 | 0.4 | 0.4 | 0.1 | 0.003 | 2 m | dry | 10 m | Tap Rinse | 5 m | RECC 3021 | 2 m | Pass | Pass |
| 4J | 7075 | 0.4 | 0.4 | 0.4 | 0.1 | 0.003 | 2 m | dry | 10 m | Tap Rinse | 5 m | RECC 3021 | 2 m | Pass | Pass |
| 4K | Clad 2024 | 0.4 | 0.4 | 0.4 | 0.1 | 0.003 | 2 m | dry | 10 m | Tap Rinse | 5 m | RECC 3021 | 2 m | Pass | Pass |
| 4L | 2024 | 0.4 | 0.4 | 0.4 | 0.1 | 0.003 | 2 m | dry | 10 m | Tap Rinse | 5 m | RECC 3021 | 2 m | Pass | Pass |
| 4M | 6061 | 0.4 | 0.4 | 0.4 | 0.1 | 0.003 | 5 m | dry | 10 m | Tap Rinse | 5 m | RECC 3021 | 2 m | Pass | Pass |

TABLE 4-continued

Summary of Paint Adhesion for Various Conversion Coated Li—P Coatings Rated Per Boeing P.S. 21313

| | | App I[1] | | | | | | | Time | | Time | | Time | | |
|---|---|---|---|---|---|---|---|---|---|---|---|---|---|---|---|
| Panel | Substrate | NaOH | $Na_3PO_4$ | $Li_2CO_3$ | PVP | Surfactant | Time I | App II | II | App III | III | App IV | IV | Dry** | Wet** |
| 4N | 7075 | 0.4 | 0.4 | 0.4 | 0.1 | 0.003 | 5 m | dry | 10 m | Tap Rinse | 5 m | RECC 3021 | 2 m | Pass | Pass |
| 4O | Clad 2024 | 0.4 | 0.4 | 0.4 | 0.1 | 0.003 | 5 m | dry | 10 m | Tap Rinse | 5 m | RECC 3021 | 2 m | Pass | Pass |
| 4P | 2024 | 0.4 | 0.4 | 0.4 | 0.1 | 0.003 | 5 m | dry | 10 m | Tap Rinse | 5 m | RECC 3021 | 2 m | Pass | Pass |
| 4Q | 6061 | 0.4 | 0.4 | 0.4 | | 0.003 | 2 m | dry | 10 m | RECC 3021 | 5 m | | | Pass | Pass |
| 4R | 7075 | 0.4 | 0.4 | 0.4 | | 0.003 | 2 m | dry | 10 m | RECC 3021 | 5 m | | | Pass | Pass |
| 4S | Clad 2024 | 0.4 | 0.4 | 0.4 | | 0.003 | 2 m | dry | 10 m | RECC 3021 | 5 m | | | Pass | Pass |
| 4T | 2024 | 0.4 | 0.4 | 0.4 | | 0.003 | 2 m | dry | 10 m | RECC 3021 | 5 m | | | Pass | Pass |
| 4U | 6061 | 0.4 | 0.4 | 0.4 | | 0.003 | 5 m | dry | 10 m | RECC 3021 | 5 m | | | Pass | NR |
| 4V | 7075 | 0.4 | 0.4 | 0.4 | | 0.003 | 5 m | dry | 10 m | RECC 3021 | 5 m | | | Pass | Pass |
| 4W | Clad 2024 | 0.4 | 0.4 | 0.4 | | 0.003 | 5 m | dry | 10 m | RECC 3021 | 5 m | | | Pass | Pass |
| 4X | 2024 | 0.4 | 0.4 | 0.4 | | 0.003 | 5 m | dry | 10 m | RECC 3021 | 5 m | | | Pass | Pass |
| 4Y | 6061 | 0.4 | 0.4 | 0.4 | | 0.003 | 2 m | dry | 10 m | Tap Rinse | 5 m | | | Pass | Pass |
| 4Z | 7075 | 0.4 | 0.4 | 0.4 | | 0.003 | 2 m | dry | 10 m | Tap Rinse | 5 m | | | Pass | Pass |
| 4AA | Clad 2024 | 0.4 | 0.4 | 0.4 | | 0.003 | 2 m | dry | 10 m | Tap Rinse | 5 m | | | Pass | Pass |
| 4BB | 2024 | 0.4 | 0.4 | 0.4 | | 0.003 | 2 m | dry | 10 m | Tap Rinse | 5 m | | | Pass | Pass |
| 4CC | 6061 | 0.4 | 0.4 | 0.4 | | 0.003 | 5 m | dry | 10 m | Tap Rinse | 5 m | | | Pass | Pass |
| 4DD | 7075 | 0.4 | 0.4 | 0.4 | | 0.003 | 5 m | dry | 10 m | Tap Rinse | 5 m | | | Pass | Pass |
| 4EE | Clad 2024 | 0.4 | 0.4 | 0.4 | | 0.003 | 5 m | dry | 10 m | Tap Rinse | 5 m | | | Pass | Pass |
| 4FF | 2024 | 0.4 | 0.4 | 0.4 | | 0.003 | 5 m | dry | 10 m | Tap Rinse | 5 m | | | Pass | Pass |

[1]Application I (App I) is a lithium based coating according to the invention with the ingredients and amounts shown in Table 4.
**"Dry" and "Wet" tests refer to Boeing P.S. 21313 Coating Adhesion Tests, Dry and Wet Tape Tests (Boeing, St. Louis, MO).

TABLE 5

Various Conversion Coated Li—P Coatings After Seven Days Salt Spray Rated Per ELM Scale

| | | App I | | | | | | | | | | | |
|---|---|---|---|---|---|---|---|---|---|---|---|---|---|
| Panel | Substrate | NaOH | $Na_3PO_4$ | $Li_2CO_3$ | PVP | Surfactant | Abraded | Time I | App II | Time II | App III | Time III | 7 Day SS |
| 5A | 2024 | 0.4 | 0.4 | 0.4 | | 0.003 | Yes | 5 m | dry | 10 m | RECC 3021 | 5 m | 9 |
| 5B | 7075 | 0.4 | 0.4 | 0.4 | | 0.003 | Yes | 5 m | dry | 10 m | RECC 3021 | 5 m | 10 |
| 5C | 2024 | 0.4 | 0.4 | 0.4 | 0.1 | 0.003 | Yes | 5 m | dry | 10 m | RECC 3021 | 5 m | 8 |
| 5D | 7075 | 0.4 | 0.4 | 0.4 | 0.1 | 0.003 | Yes | 5 m | dry | 10 m | RECC 3021 | 5 m | 8 |

[1]Application I (App I) is a lithium based coating according to the invention with the ingredients and amounts shown in Table 5.

TABLE 6

Various Conversion Coated Li—P Coatings After Two Days Salt Spray Rated Per ELM Scale

| | | App I[1] | | | | | | | | | | | |
|---|---|---|---|---|---|---|---|---|---|---|---|---|---|
| Panel | Substrate | NaOH | $Na_3PO_4$ | $Li_2CO_3$ | Surfactant | Time I | App II | Time II | App III | Time III | App IV | Time IV | 2 Day SS |
| 6A | 2024 | 0.4 | 0.4 | 0.4 | 0.003 | 10 Sec | dry | 10 min | Tap Rinse | 5 min | | | 9 |
| 6B | 2024 | 0.4 | 0.4 | 0.4 | 0.003 | 2 min | dry | 10 min | Tap Rinse | 5 min | | | 9 |
| 6C | 2024 | 0.4 | 0.4 | 0.4 | 0.003 | 5 min | dry | 10 min | Tap Rinse | 5 min | | | 9 |
| 6D | 2024 | 0.4 | 0.4 | 0.4 | 0.003 | 10 sec | dry | 10 min | Tap Rinse | 5 min | RECC 3021 | 2 m | 9 |
| 6E | 2024 | 0.4 | 0.4 | 0.4 | 0.003 | 2 min | dry | 10 min | Tap Rinse | 5 min | RECC 3021 | 2 m | 9 |
| 6F | 2024 | 0.4 | 0.4 | 0.4 | 0.003 | 5 min | dry | 10 min | Tap Rinse | 5 min | RECC 3021 | 2 m | 9 |
| 6G | 2024 | 0.4 | 0.4 | 0.4 | 0.003 | 10 sec | dry | 10 min | Tap Rinse | 5 min | RECC 3021 | 5 min | 9 |
| 6H | 2024 | 0.4 | 0.4 | 0.4 | 0.003 | 2 min | dry | 10 min | Tap Rinse | 5 min | RECC 3021 | 5 min | 9 |
| 6I | 2024 | 0.4 | 0.4 | 0.4 | 0.003 | 5 min | dry | 10 min | Tap Rinse | 5 min | RECC 3021 | 5 min | 9 |

[1]Application I (App I) is a lithium based coating according to the invention with the ingredients and amounts shown in Table 6.

TABLE 7

Non-Chrome Pretreatment and Non-Chrome Primer**, Rated After 1,000 Hr Salt Spray Exposure Per Keller Scale

| | | App I[1] | | | | | | | | | | | |
|---|---|---|---|---|---|---|---|---|---|---|---|---|---|
| Panel | Substrate | NaOH | $Na_3PO_4$ | $Li_2CO_3$ | Surfactant | Time I | App II | Time II | App III | Time III | App IV | Time IV | 1 K S.S.** |
| 7A | Clad 2024 | 0.4 | 0.4 | 0.4 | 0.003 | 3 m | dry | 10 | tap | 3 m | RECC 3021 | 5 min | 1, 4 A |
| 7B | Clad 2024 | 0.4 | 0.4 | 0.4 | 0.003 | 3 m | dry | 10 | tap | 3 m | RECC 3021 | 5 min | 1, 4 A |
| 7C | 2024 | 0.4 | 0.4 | 0.4 | 0.003 | 3 m | dry | 10 | tap | 3 m | RECC 3021 | 5 min | 1, 4 A |
| 7D | 2024 | 0.4 | 0.4 | 0.4 | 0.003 | 3 m | dry | 10 | tap | 3 m | RECC 3021 | 5 min | 1, 4 A |

[1]Application I (App I) is a lithium based coating according to the invention with the ingredients and amounts shown in Table 7.
**Primed using a MIL-PRF-23377 Class N Candidate - Chrome Free Primer (2GN093, Deft, Inc.)

TABLE 8

Non-Chrome Pretreatment and Non-Chrome Primer**, Rated after 2,000 Hours Salt Spray Exposure Per Keller Scale

| | | App I[1] | | | | | | | Time | | Time | | | 2 K |
|---|---|---|---|---|---|---|---|---|---|---|---|---|---|---|
| Panel | Substrate | NaOH | $Na_3PO_4$ | $Li_2CO_3$ | Surfactant | Allantoin | Time I | App II | II | App III | III | App IV | Time IV | S.S.** |
| 8A | 2024 | 0.4 | 0.4 | 0.4 | 0.003 | 0.008 | 1 m | dry | 10 m | tap | 5 m | RECC 3021 | 5 min | 1, 4 A |
| 8B | 2024 | 0.4 | 0.4 | 0.4 | 0.003 | 0.008 | 1 m | dry | 10 m | tap | 5 m | RECC 3021 | 5 min | 2, 5 A |
| 8C | 2024 | 0.4 | 0.4 | 0.4 | 0.003 | 0.008 | 3 m | dry | 10 m | tap | 5 m | RECC 3021 | 5 min | 1, 4 A |
| 8D | 2024 | 0.4 | 0.4 | 0.4 | 0.003 | 0.008 | 3 m | dry | 10 m | tap | 5 m | RECC 3021 | 5 min | 1, 4 A |
| 8E | 2024 | 0.4 | 0.4 | 0.4 | 0.003 | 0.008 | 5 m | dry | 10 m | tap | 5 m | RECC 3021 | 5 min | 1, 4 A |
| 8F | 2024 | 0.4 | 0.4 | 0.4 | 0.003 | 0.008 | 5 m | dry | 10 m | tap | 5 m | RECC 3021 | 5 min | 1, 4 A |
| 8G | 2024 | 0.4 | 0.4 | 0.4 | 0.003 | 0.008 | 3 m | dry | 7 m | tap | 5 m | RECC 3021 | 5 min | 1, 5 A |
| 8H | 2024 | 0.4 | 0.4 | 0.4 | 0.003 | 0.008 | 3 m | dry | 7 m | tap | 5 m | RECC 3021 | 5 min | 1, 4 A |
| 8I | 2024 | 0.4 | 0.4 | 0.4 | 0.003 | 0.008 | 3 m | dry | 7 m | tap | 5 m | RECC 3021 | 5 min | 1, 4 A |
| 8J | 2024 | 0.4 | 0.4 | 0.4 | 0.003 | 0.008 | 3 m | dry | 7 m | tap | 5 m | RECC 3021 | 5 min | 1, 4 A |
| 8K | 2024 | 0.4 | 0.4 | 0.4 | 0.003 | 0.008 | 3 m | dry | 7 m | tap | 5 m | RECC 3021 | 5 min | 1, 5 A |

[1]Application I (App I) is a lithium based coating according to the invention with the ingredients and amounts shown in Table 8. App I was applied to Al-2024T3 panels which were abraded.
**Primed using a MIL-PRF-23377 Class N Candidate - Chrome Free Primer (2GN093, Deft, Inc.)

TABLE 9

Comparison of Cr Coated and Various Li—P Coated Al 2024 Substrates, Subjected To 7 and 14 day Salt Spray.

| | | App I[1] | | | | | | | App | Time | App | Time | App | Time | 7 Day or 14 Day |
|---|---|---|---|---|---|---|---|---|---|---|---|---|---|---|---|
| Panel | Abraded | $Li_2CO_3$ | $^-OH$ | Phosphate | PVP | Surfactant | App I | Time I | II | II | III | III | IV | IV | SS |
| 9A | Yes | 0.4 | 0.4 NaOH | 0.4 $Na_3PO_4$ | 0.04 | 0.003 | Spray | 3 m | dry | 7 m | RECC 3021 | 5 m | | | 9* |
| 9B | Yes | 0.4 | 0.4 NaOH | 0.4 $Na_3PO_4$ | 0.04 | 0.003 | Spray | 3 m | dry | 7 m | Tap Rinse | 5 m | RECC 3021 | 5 m | 8* |
| 9C Cr Control Spray | Yes | | | Alodine ® 1200 | | | Spray | | | | | | | | 5* |
| 9D Cr Control Dip I | No | | | Alodine ® 1200 | | | Imms. | | | | | | | | 9* |
| 9E Cr Control Dip II | No | | | Alodine ® 600 | | | Imms. | | | | | | | | 8* |
| 9F | Yes | 0.4 | 0.4 NaOH | 0.4 $Na_3PO_4$ | | 0.003 | Spray | 3 m | dry | 7 m | | | | | 6* |

TABLE 9-continued

Comparison of Cr Coated and Various Li—P Coated Al 2024 Substrates, Subjected To 7 and 14 day Salt Spray.

| | | App I[1] | | | | | | | App | Time | App | Time | App | Time | 7 Day or 14 Day |
|---|---|---|---|---|---|---|---|---|---|---|---|---|---|---|---|
| Panel | Abraded | $Li_2CO_3$ | $^-OH$ | Phosphate | PVP | Surfactant | App I | Time I | II | II | III | III | IV | IV | SS |
| 9G | No | | 0.4 LiOH | 0.2 $Na_4P_2O_7$ | | 0.003 | Spray | 3 m | dry | 7 m | RECC 3031 | 2 m | RECC 3031 | 2 m | 9** |
| 9H/9I[2] | No | | 0.4 LiOH | 0.2 $Na_4P_2O_7$ | | 0.003 | Spray | 3 m | dry | 7 m | RECC 3031 | 2 m | RECC 3031 | 2 m | 8* |
| 9J/9K[2] Cr Control Dip I | No | | | Alodine ® 1200 | | | Imms. | | | | | | | | 9* |
| 9L/9M[2] Cr Control Dip II | No | | | Alodine ® 600 | | | Imms. | | | | | | | | 7* |

[1]Application I (App I) is either a lithium based coating according to the invention with the ingredients and amounts shown in Table 9, or a chromium based conversion coating, as indicated in Table 9. App I was applied to Al-2024 T3 panels by either spray coating or immersion as indicated in Table 9.
[2]Duplicate panels.

Although the present invention has been discussed in considerable detail with reference to certain preferred embodiments, other embodiments are possible. Therefore, the scope of the appended claims should not be limited to the description of preferred embodiments contained herein.

What is claimed is:

1. A conversion composition for application to an aluminum substrate, the composition comprising:

an aqueous carrier;

at least one Group 1A metal ion;

a hydroxide ion;

a phosphate ion comprising $(PO_4)^{3-}$; and one or more additional components selected from the group consisting of polyvinylpyrrolidone, fluoride, a carbonate, a surfactant, a thickener, allantoin, 1,5-Dimercapto-1,3,4-thiadiazole, a halide, a silane, and an alcohol;

wherein contact of the conversion composition with a surface of the substrate leads to precipitation of a coating thereon; and wherein the pH of the composition is greater than 10.

2. The conversion composition of claim 1, wherein the conversion composition is substantially free of metals other than the than Group 1A metals.

3. The conversion composition of claim 1, wherein the composition is substantially free of Group 3 through Group 12 metals.

4. The conversion composition of claim 1, wherein at least one of the Group 1A metal ions comprises lithium.

5. The conversion composition of claim 4, wherein the lithium is provided by a compound present in an amount of 0.02 g/1000 g of conversion composition to 12 g/1000 g of conversion composition.

6. The conversion composition of claim 4, wherein a second Group 1A metal ion is selected from the group consisting of sodium, potassium, and combinations thereof.

7. The conversion composition of claim 5, wherein the sodium is provided by a compound present in an amount of 0.2 g/1000 g of conversion composition to 16 g/1000 g of conversion composition.

8. The conversion composition of claim 1, wherein the hydroxide ion is provided by a compound present in an amount of 0.09 g/1000 g of conversion composition to 16 g/1000 g of conversion composition.

9. The conversion composition of claim 1, wherein the phosphate ion further comprises a pyrophosphate $(P_2O_7)^{4-}$, and/or a polyphosphate.

10. The conversion composition of claim 1, wherein the phosphate ion further comprises a di-hydrogen phosphate $(H_2PO_4)^-$, and/or a pyrophosphate $(P_2O_7)^{4-}$.

11. The conversion composition of claim 1, wherein the phosphate ion further comprises an organophosphate compound.

12. The conversion composition of claim 1, wherein the phosphate ion is provided by a compound present in an amount of 0.2 g/1000 g of conversion composition to 16 g/1000 g of conversion composition.

13. The conversion composition of claim 1, wherein the carbonate ion is provided by a compound present in an amount of 0.05 g/1000 g of conversion composition to 12 g/1000 g of conversion composition.

14. The conversion composition of claim 1, wherein the composition is substantially chromate free.

15. A substrate, comprising:

a coating formed on at least a portion of a surface of the substrate by the composition of claim 1.

* * * * *